US011795947B2

(12) United States Patent
Chang

(10) Patent No.: US 11,795,947 B2
(45) Date of Patent: Oct. 24, 2023

(54) COMPRESSOR STRUCTURE

(71) Applicant: CH CREATIVE CO., LTD., Taipei (TW)

(72) Inventor: Jui-Cheng Chang, Keelung (TW)

(73) Assignee: CH Creative Co., Ltd., Taipei (TW)

( * ) Notice: Subject to any disclaimer, the term of this patent is extended or adjusted under 35 U.S.C. 154(b) by 39 days.

(21) Appl. No.: 17/500,398

(22) Filed: Oct. 13, 2021

(65) Prior Publication Data

US 2022/0120273 A1 Apr. 21, 2022

(30) Foreign Application Priority Data

Oct. 15, 2020 (TW) ..... 109135714

(51) Int. Cl.

| | |
|---|---|
| ***F04C 2/324*** | (2006.01) |
| ***F04C 2/332*** | (2006.01) |
| ***F04C 2/348*** | (2006.01) |
| ***F04C 29/02*** | (2006.01) |
| ***F04C 18/34*** | (2006.01) |
| ***F04C 15/00*** | (2006.01) |

(52) U.S. Cl.

CPC ..... *F04C 2/324* (2013.01); *F04C 2/332* (2013.01); *F04C 15/0023* (2013.01); *F04C 2240/20* (2013.01); *F04C 2240/30* (2013.01); *F04C 2240/60* (2013.01); *F04C 2240/805* (2013.01)

(58) Field of Classification Search

CPC ..... F04C 2/324; F04C 2/332; F04C 2/348; F04C 15/0023; F04C 14/10

See application file for complete search history.

(56) References Cited

U.S. PATENT DOCUMENTS 1,712,935 A * 5/1929 Seaholm ..... F04C 2/348 418/173

* cited by examiner

*Primary Examiner* — Deming Wan

(74) *Attorney, Agent, or Firm* — Rosenberg, Klein & Lee

(57) ABSTRACT

A compressor structure includes a vane rotor and a cylinder eccentrically disposed around the vane rotor. The vane rotor has a vane impeller. The vane impeller is in tangential contact with the cylinder to define an eccentric crescent vane chamber. A vane is radially slidably received in the vane impeller. An outward extending top end of the vane tightly abuts against the inner circumferential wall of the vane chamber, whereby the vane chamber is partitioned into an intake section and a compression exhaustion section. When the vane rotor rotates, the vane is driven to drive the cylinder to complete gas compression operation. When rotating, the vane is simply swung at a fixed position of the cylinder, the friction of the compressor can be lowered. The communication of the gas outlet is regulated so that the compression ratio of the compressed gas exhausted from the compressor can be changed.

19 Claims, 16 Drawing Sheets

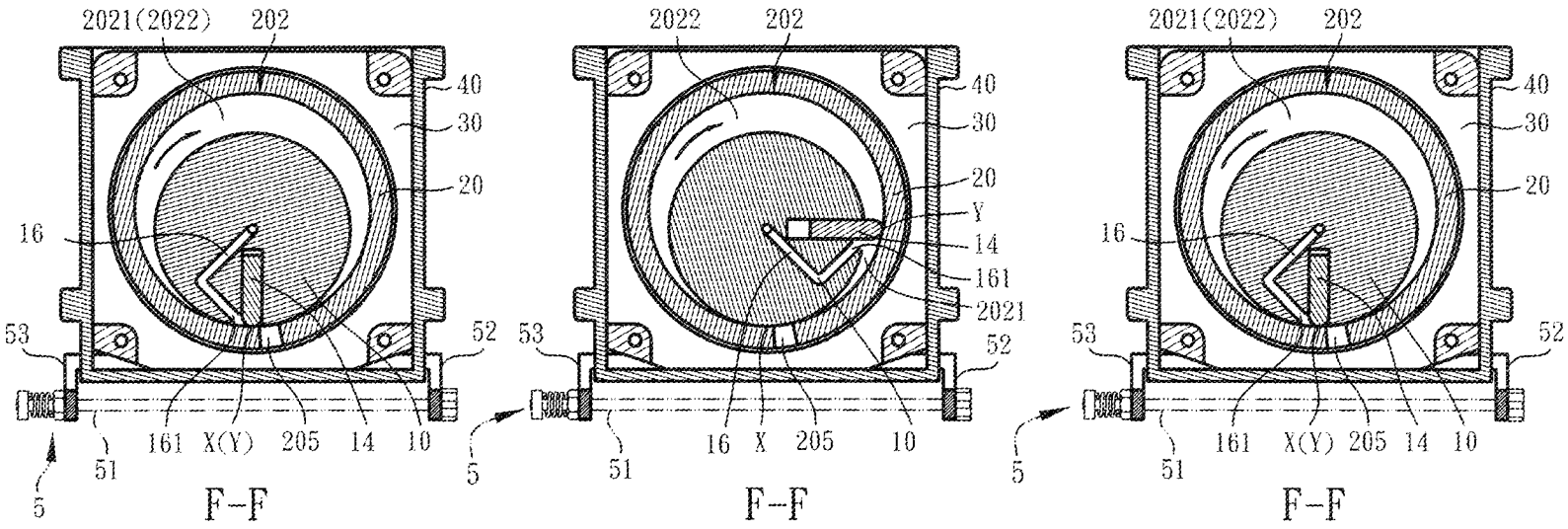
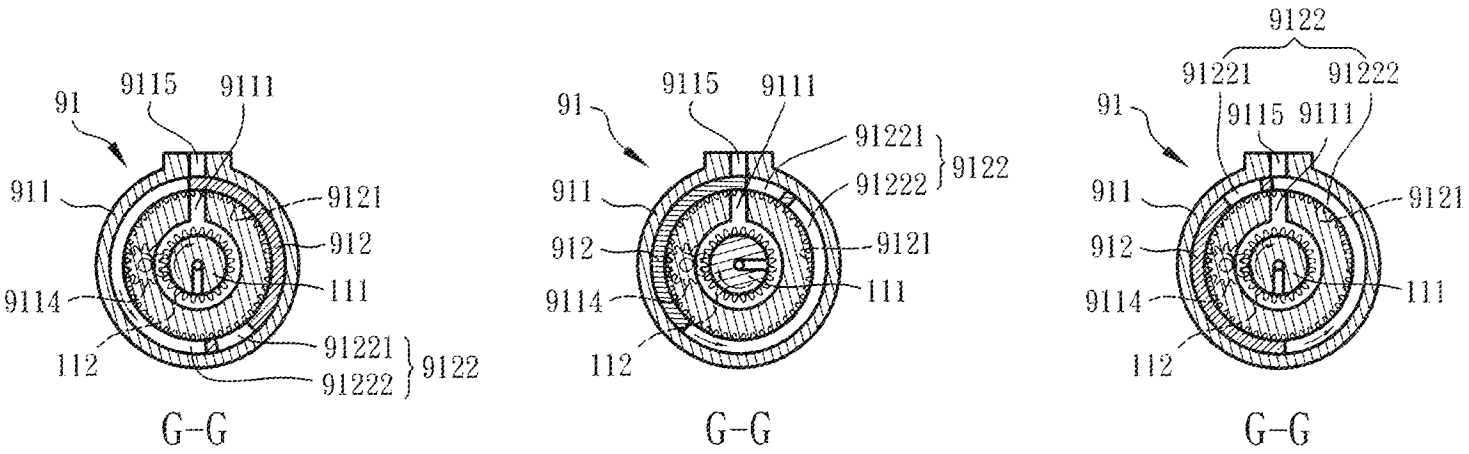
Fig. 21A
Fig. 21B
Fig. 21C

COMPRESSOR STRUCTURE

BACKGROUND OF THE INVENTION

1. Field of the Invention

The present invention relates generally to a compressor structure, and more particularly to a compressor structure, which can reduce the frictional wear between the vane impeller and the inner circumference of the vane chamber. Moreover, the compression ratio of the compressor can be adjusted as necessary and the compressor can be switched between different compression ratios or diverse functions such as a pump. Therefore, the compressor structure has highly practical value.

2. Description of the Related Art

As shown in FIG. 1, a conventional rotary vane compressor mainly includes a cylinder 7 and a vane rotor 8. The cylinder 7 is formed with an internal vane chamber 71 with a circular cross section. A gas outlet 72 and a gas inlet 73 are disposed on a circumference of the vane chamber 71 in communication with outer side. The vane rotor 8 is eccentrically disposed in the vane chamber 71 between the gas outlet 72 and the gas inlet 73 near one side of the gas outlet 72 and one side of the gas inlet 73. Multiple vanes 80 are radially telescopically disposed on outer circumference of a vane impeller 81 of the vane rotor 8. Each vane 80 has an outward extending end 801, which always abuts against an inner wall 710 of the vane chamber 71. In a preferred embodiment, the cylinder 7 is retained in a main body 70.

In operation, when the vanes 80 pass through the gas inlet 73, the gas entering the vane chamber 71 through the gas inlet 73 between two adjacent vanes 80 is gradually pushed toward the gas outlet 72. The capacity of the vane chamber 71 between two adjacent vanes 80 is gradually reduced so that the gas passing through the vane chamber 71 between two adjacent vanes 80 is compressed into high-pressure gas. Thereafter, the gas passes through the gas outlet 72 to be guided out, whereby the air compression operation is completed.

However, in operation of the above compressor, the vanes 80 and the vane impeller 81 always frictionally slide against the inner wall 710 of the vane chamber 71. This leads to continuous wear loss between the vanes 80 and the vane impeller 81 and the inner wall 710 of the vane chamber 71. As a result, not only a great amount of energy is lost, but also high heat is generated due to friction, it is hard to dissipate the heat so that the use performance and durability and lifetime of the product are seriously affected.

In the above arrangement, the gas outlet 72 and the gas inlet 73 of the vane chamber 71 have fixed positions so that in operation of the vanes 80 and the vane impeller 81, the vanes 80 and the vane impeller 81 will both apply frictional force to the fixed contact portion 7101 of the inner wall 710 of the vane chamber 71. The longer the compressor is used, the more apparent the denting extent caused by the wear of the fixed contact portion 7101 is. In operation, when the vanes 80 pass through the dented portion, the vanes 80 will jump or shake. This seriously affects the airtightness and quietness during the operation process and should be improved.

Furthermore, the conventional rotary vane compressor structure simply has gas compression function and can only compress air by fixed compression ratio without possibility of easy regulation or change of the compression ratio. This seriously limits the practical application range provided by the compressor.

It is therefore tried by the applicant to provide a compressor structure to eliminate the shortcomings existing in the conventional rotary vane compressor.

SUMMARY OF THE INVENTION

It is therefore a primary object of the present invention to provide a compressor structure including a vane rotor and a cylinder eccentrically disposed around the vane rotor and pivotally rotatably disposed on a main seat. The vane rotor has a vane impeller. A circumferential wall of the vane impeller is in tangential contact with an inner circumferential wall of the cylinder to define an axial partitioning line and form an eccentric crescent vane chamber in the cylinder. A radial vane slot is formed on the circumference of the vane impeller of the vane rotor. A vane is slidably received in the vane slot. An outward extending top end of the vane has vane pivotally connecting sections, which are securely pivotally connected with two sides of the inner circumferential wall of the cylinder, whereby the top end of the vane tightly abuts against (or is inlaid in) the inner circumferential wall of the cylinder to partition the interior of the vane chamber into an intake section and a compression exhaustion section. The intake section is in communication with a gas inlet. The compression exhaustion section is in communication with a gas outlet. When the vane rotor rotates, the vane is driven by the vane rotor. At the same time, the vane pivotally connecting sections of the vane drive the cylinder to rotate with the vane rotor so as to take gas from the gas inlet into the vane chamber. After compressed, the gas is exhausted from the gas out let to complete gas compression operation. When the cylinder is driven by the vane to rotate, the vane pivotally connecting sections of the vane are limited by the eccentrically rotational track of the cylinder relative to the vane rotor so that the vane simply tightly abuts against (or is inlaid in) a fixed position of the inner circumferential wall of the cylinder and swings about the fixed position. Therefore, during the compression process, the vane will not be retracted back into the vane slot due to excessively great pressure of the internal gas to make a gap. In addition, the vane will not frictionally contact any other part of the inner circumferential wall of the vane chamber. Also, the vane rotor is eccentrically tangential to the cylinder and rotated along therewith so that the friction between the vane rotor and the cylinder in each cycle of rotation is simply equivalent to the sliding friction of the difference between the circumferential lengths of the vane rotor and the cylinder in contact with each other. This can effectively reduce the wear of the components of the entire compressor and the loss of energy.

In the above compressor structure, two support bodies are respectively disposed on two lateral sides of the main seat. At least one automatic adjustment assembly is disposed between the support bodies and the main seat. The automatic adjustment assembly is used to make the inner circumferential wall of the cylinder always tightly abut against the circumferential wall of the vane impeller of the vane rotor so as to automatically adjust and eliminate the gap between the inner circumferential wall of the cylinder and the circumferential wall of the vane impeller of the vane rotor.

In the above compressor structure, in the case that the gas outlet is disposed on the cylinder, an out-guiding hole can be disposed on one side of the main seat to set up the overlapping position of the gas out let and the out-guiding hole in rotation of the cylinder. The initial overlapping position is exactly the compression ratio setting of the gas exhausted from the compressor. Alternatively, in the case that the gas outlet is disposed on the vane rotor, the gas outlet is in communication with at least one gas exhaustion port on a rotor shaft of the vane rotor via a gas exhaustion passage inside the vane rotor. A shaft end gas exhaustion control assembly is assembled with an end section of the rotor shaft with the gas exhaustion port. At least one out-guiding notch is disposed on the shaft end gas exhaustion control assembly so as to set up the overlapping position of the gas exhaustion port of the rotor shaft and the out-guiding notch of the shaft end gas exhaustion control assembly in rotation of the vane rotor. The initial overlapping position is exactly the compression ratio setting of the gas exhausted from the compressor.

In the above compressor structure, in the case that the gas outlet is disposed on the cylinder, a compression ratio regulation assembly can be additionally disposed between the out-guiding hole of the main seat and the gas outlet. Alternatively, in the case that the gas outlet is disposed on the vane rotor in communication with a gas exhaustion port on a rotor shaft, a compression ratio regulation assembly can be additionally disposed between the out-guiding notch of the shaft end gas exhaustion control assembly and the gas exhaustion port. The compression ratio regulation assembly has a regulation opening corresponding to the out-guiding hole or the out-guiding notch. When the compression ratio regulation assembly is operated to regulate the compression ratio, the initial overlapping position of the gas outlet and the out-guiding hole or the out-guiding notch can be adjusted and changed so as to change the timing for the gas outlet and the out-guiding hole or the out-guiding notch to communicate with each other and exhaust the gas. Accordingly, the effect of changing the exhaustion compression ratio of the compressed gas of one single compressor can be achieved.

In the above compressor structure, the shaft end gas exhaustion control assembly is composed of an end cap seat and an out-guiding notch control ring cap with an opening. A rotor shaft socket is formed at a center of the end cap seat and sealedly capped around the end section of the first rotor shaft corresponding to the position where the gas exhaustion port is formed. At least one through hole is formed on the end cap seat in communication with outer side and corresponding to the rotor shaft socket. A central hole is formed at a center of the rotor shaft socket through the end cap seat. An annular groove is formed on the other side of the end cap seat concentrically around the central hole and spaced from the central hole. A rim of the open end of the out-guiding notch control ring cap is inlaid in the annular groove. The rim of the out-guiding notch control ring cap that is inlaid in the annular groove is formed with at least one annular rail. At least one notch segment is disposed on the annular rail. Each notch segment has a notch part. The annular rail corresponds to the through hole and is positioned in the same axial position as the through hole. When the out-guiding notch control ring cap operates, each notch segment will pass through the through hole. Each time period for each notch segment to pass through the through hole just corresponds to one-cycle rotation of the vane rotor. Therefore, in one-cycle rotation of the out-guiding notch control ring cap, the corresponding number of the rotational cycles of the vane rotor is equivalent to the number of the notch segments set on the out-guiding notch control ring cap. Accordingly, the compression extent of the gas exhausted from the compressor is the set compression ratio of the notch segment passing through the through hole. Therefore, the operation of the compressor can be switched between the notch segments with different set compression ratios. In the case that the notch segment is set without compression, the entire notch segment is a notch. Under such circumstance, the compressor will functionally serve as a pump. Therefore, the compressor structure of the present invention can provide another special application.

The present invention can be best understood through the following description and accompanying drawings, wherein:

BRIEF DESCRIPTION OF THE DRAWINGS

FIG. 21A is a cross-sectional view of the fifth embodiment of the present invention, which is taken along line F-F and line C-G of FIG. 20 to show that the compressor is situated at an initial stage of the corresponding operation of the first notch segment of the first annular rail;

FIG. 21B is a cross-sectional view of the fifth embodiment of the present invention, which is taken along line F-F and line G-G of FIG. 20 to show that the compressor is situated at a starting stage of the corresponding gas exhaustion operation of the first notch segment of the first annular rail;

FIG. 21C is a cross-sectional view of the fifth embodiment of the present invention, which is taken along line F-F and line G-G of FIG. 20 to show that the compressor is situated at a finished stage of the corresponding operation of the first notch segment of the first annular rail, that is, situated at an initial stage of the corresponding operation of the second notch segment;

DETAILED DESCRIPTION OF THE PREFERRED EMBODIMENTS

Figure 1:
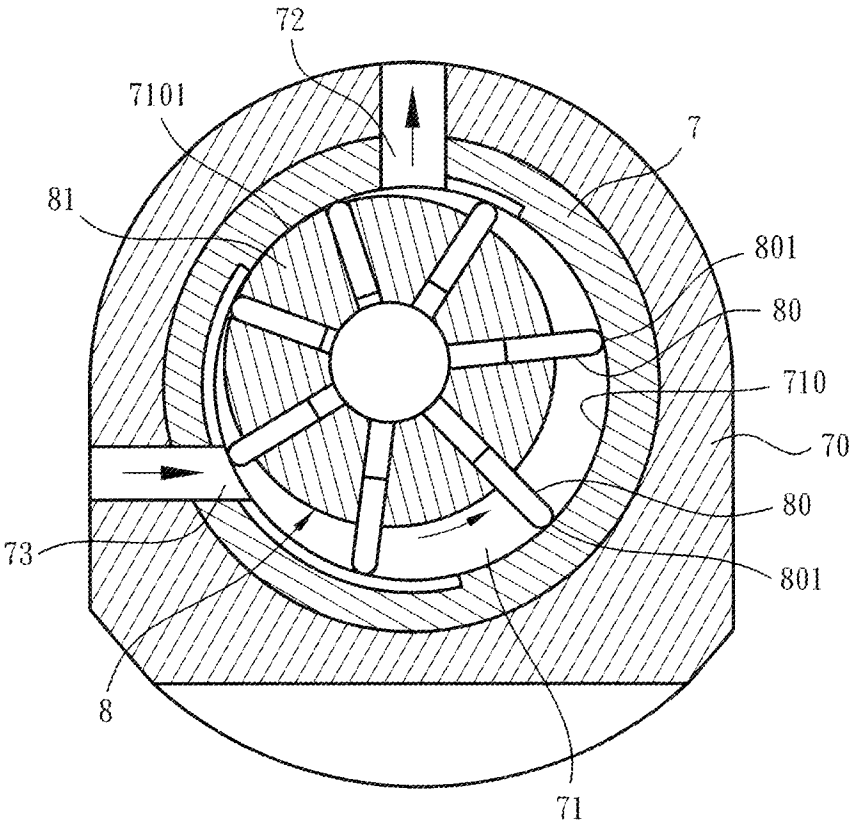
Fig. 1 PRIOR ART
FIG. 1 is a sectional view of a conventional rotary vane compressor structure.

Please refer to FIGS. 2 to 7. According to a first embodiment, the compressor structure of the present invention includes a vane rotor 1, a cylinder 2 and a main seat 3. The vane rotor 1 has a cylindrical vane impeller 10. A first rotor shaft 11 and a second rotor shaft 12 are respectively disposed at two ends of a center of the vane impeller 10. In addition, a radial vane slot 13 is formed on the vane impeller 10. At least one of the first rotor shaft 11 and the second rotor shaft 12 is formed with an internal ventilation passage 131 in communication with the vane slot 13. At least one of the first rotor shaft 11 and the second rotor shaft 12 is connected to an external power supply via a transmission member 15 (such as a gear or a belt pulley) for driving the vane rotor 1 to rotate. A radially slidable vane 14 is received in the vane slot 13. The vane 14 has an outward extending end extending out of the vane slot 13. The outward extending end of the vane 14 is formed with vane pivotally connecting sections 141. In this embodiment, the vane pivotally connecting sections 141 are two vane protruding shafts laterally protruding from two sides of the vane 14.

The cylinder 2 is eccentrically disposed around the vane rotor 1. The cylinder 2 is composed of a cylindrical cylinder main body 20 and a cylinder cap body 21. The cylinder main body 20 is formed with an internal concentric cylindrical vane chamber 202. The vane chamber 202 has an opening 201 on one side. The vane chamber 202 has an inner circumferential wall 203. A circumference of the vane impeller 10 is tangential to the inner circumferential wall 203 of the vane chamber 202 at an axial partitioning line X to define a crescent vane chamber capacity space. The vane pivotally connecting sections 141 can be pivotally connected with two sides of the inner circumferential wall 203 of the vane chamber 202, whereby a top end of the vane 14 tightly abut against the inner circumferential wall 203 of the vane chamber 202 (the cylinder main body 20) along an axial vane contact line Y. In addition, on the circumferential wall of the cylinder main body 20 immediately in adjacency to two sides of the axial vane contact: line Y are formed a gas outlet 204 in an advancing direction of the vane 14 and a gas inlet 205 in a direction reverse to the advancing direction of the vane 14. The gas outlet 204 and the gas inlet 205 are respectively positioned in different axial positions of the cylinder main body 20. A shaft hole 206 is formed at a center of a sidewall of the cylinder main body 20 distal from the opening 201. In addition, a vane pivotally connected section 207 is disposed on the sidewall immediately in adjacency to the inner circumferential wall 203 of the vane chamber 202.

The opening 201 of the cylinder main body 20 is sealed by the cylinder cap body 21. The cylinder cap body 21 is formed with a subsidiary shaft hole 211 corresponding to the shaft hole 206 of the cylinder main body 20 and a subsidiary vane pivotally connected section 212 corresponding to the vane pivotally connecting section 207 of the cylinder main body 20. The vane pivotally connecting sections 141 of the vane 14 are respectively pivotally connected with the vane pivotally connecting section 207 and the subsidiary vane pivotally connected section 212.

The main seat 3 is composed of a main seat main body 30 and a main seat subsidiary body 31. A circular cylinder receiving chamber 301 is formed on one side of the main seat main body 30, which side faces the cylinder 2. The cylinder receiving chamber 301 has an opening 300 and serves to receive a lateral end of the cylinder main body 20 proximal to the gas outlet 204. The other lateral end of the cylinder main body 20 proximal to the gas inlet 205 is exposed to outer side of the cylinder receiving chamber 301. A shaft seat 302 is disposed at a center of a sidewall of the main seat main body 30 distal from the opening 300. The shaft seat 302 is eccentric from a rotational center of the vane rotor 1. The shaft seat 203 can be pivotally fitted in the shaft hole 206 of the cylinder main body 20, whereby the cylinder main body 20 can pivotally rotate around the shaft seat 302. In addition, an eccentric shaft hole 303 is formed on the shaft seat 302 of the main seat main body 30. The cylinder receiving chamber 301 has a circular inner circumferential wall 3011. An out-guiding hole 305 is formed between the inner circumferential wall 3011 and an outer wall 304 of the main seat main body 30 and positioned in adjacency to the axial partitioning line X.

A main seat subsidiary body 31 is disposed on one side of the cylinder receiving chamber 301 of the main seat main body 30 and directed to the cylinder 2. The main seat subsidiary body 31 is spaced from the main seat main body 30 by the cylinder 2. A subsidiary shaft seat 311 is disposed on one side of the main seat subsidiary body 31 corresponding to the shaft seat 302 of the main seat main body 30, which sides faces the cylinder receiving chamber 301. In addition, a subsidiary eccentric shaft hole 312 is formed on the subsidiary shaft seat 311 corresponding to the eccentric shaft hole 303 of the main seat main body 30. The subsidiary shaft seat 311 can be pivotally fitted in the subsidiary shaft hole 211, whereby the cylinder cap body 21 can pivotally rotate around the subsidiary shaft seat 311.

Figure 2:
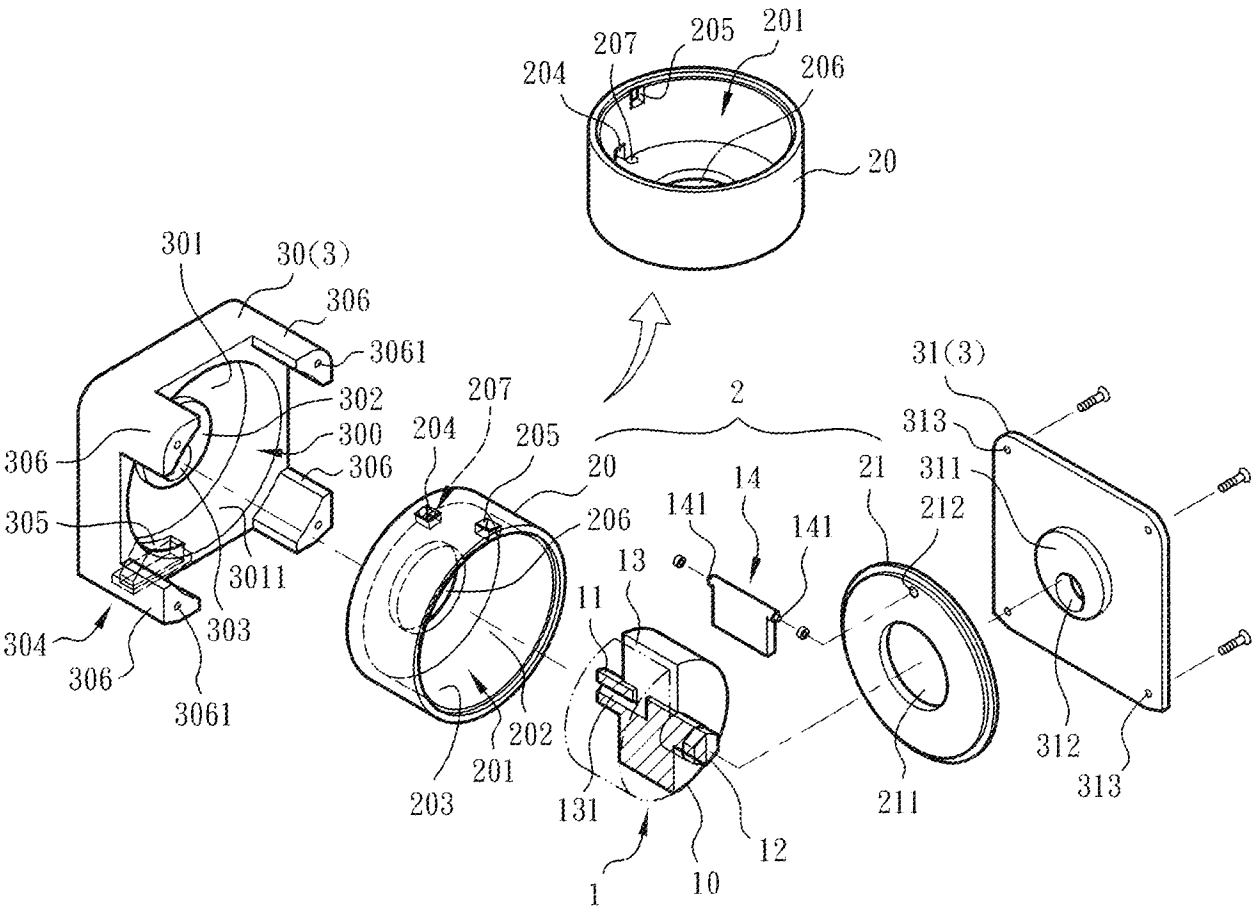
FIG. 2 is a perspective exploded view of a first embodiment of the present invention.
Figure 3B:
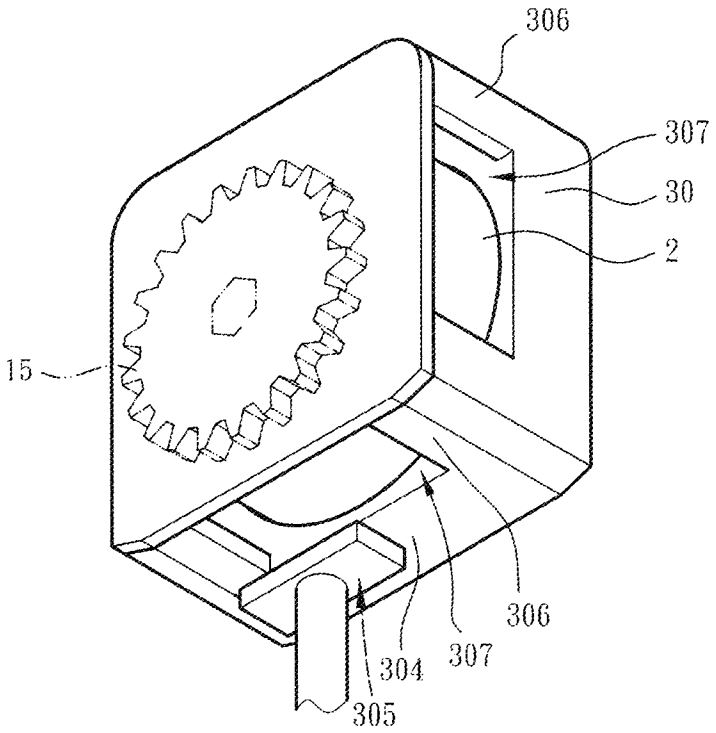
FIG. 3B is a perspective assembled view of the first embodiment of the present invention, seen from the bottom side.
Figure 3A:
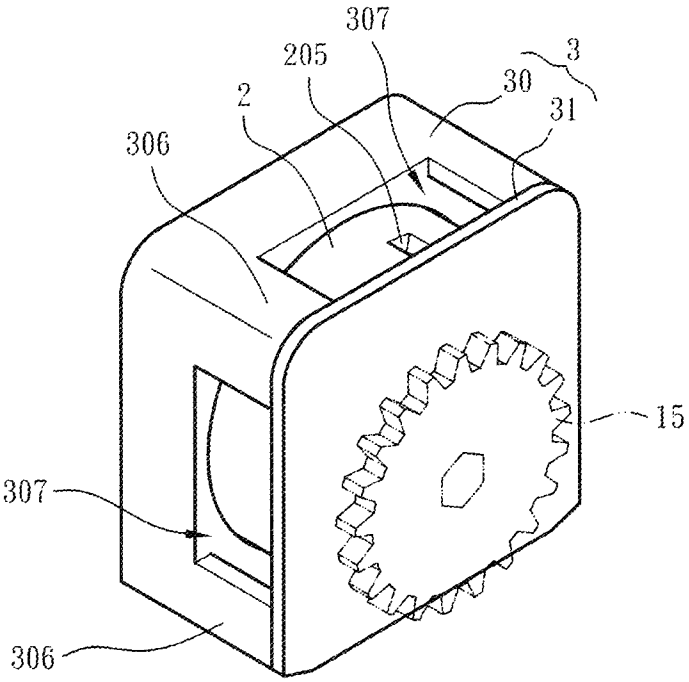
FIG. 3A is a perspective assembled view of the first embodiment of the present invention.
Figure 5:
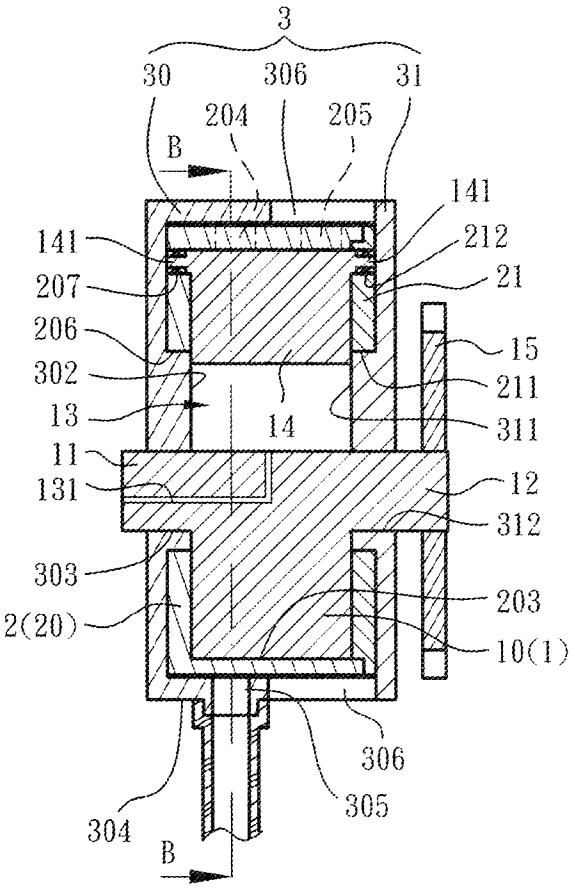
FIG. 5 is a longitudinally sectional view of the vane rotor of the first embodiment of the present invention, which is taken along line A-A of FIG. 4 to show the structure of the first embodiment of the present invention.
Figure 4:
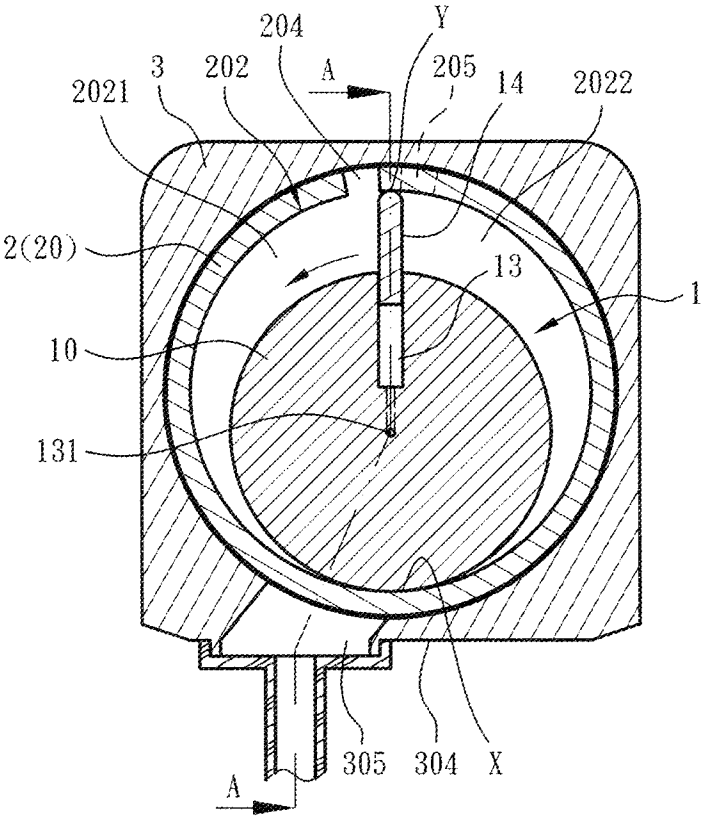
FIG. 4 is a cross-sectional view of the vane rotor of the first embodiment of the present invention, which is taken along line B-B of FIG. 5 to show the structure of the first embodiment of present invent ion.

It can be known from the above structural assembling relationship that the cylinder 2 is pivotally rotatable with the shaft seat 302 of the main seat main body 30 and the subsidiary shaft seat 311 of the main seat subsidiary body 31 serving as two rotary shafts on two sides. In order to make the cylinder 2 tightly rotate within the main seat 3 in a balanced state, assembling supports are disposed between the main seat main body 30 and the main seat subsidiary body 31 to securely assemble the main seat main body 30 and the main seat subsidiary body 31 with each other. As shown in FIG. 2, in this embodiment, four connection supports 306 are disposed on the main seat main body 30. Each connection support 306 is formed with a threaded hole 3061. The main seat subsidiary body 31 is formed with four subsidiary body threaded holes 313 in positions corresponding to the four threaded holes 3061. Accordingly, screws can be locked through the subsidiary body threaded holes 313 into the threaded holes 3061 of the connection supports 306 so as to securely assemble the main seat main body 30 and the main seat subsidiary body 31 with each other. In addition, a hollow section 307 is defined between the main seat main body 30 and the main seat subsidiary body 31, whereby the gas inlet 205 is exposed to outer side through the hollow section 307. The main seat main body 30 and the main seat subsidiary body 31 can be securely assembled by various other means, which will not be redundantly described hereinafter.

Please refer to FIGS. 2 to 7. When the vane rotor 1, the cylinder 2 and the main seat 3 are assembled with each other, the cylinder 2 is disposed in the cylinder receiving chamber 301 of the main seat 3 with the shaft seat 302 and the subsidiary shaft seat 311 of the main seat 3 pivotally fitted in the shaft hole 206 and the subsidiary shaft hole 211. The first rotor shaft 11 and the second rotor shaft 12 of the vane rotor 1 are rotatably fitted in the eccentric shaft hole 303 and the subsidiary eccentric shaft hole 312. The vane chamber 202 of the cylinder 2 is eccentrically positioned around the vane rotor 1. The circumferential wall of the vane impeller 10 of the vane rotor 1 is in tangential contact with the inner circumferential wall 203 of the vane chamber 202 at the axial partitioning line X. In addition, the top end of the vane 14 cooperatively tightly abut against the inner circumferential wall 203 of the vane chamber 202 along the axial vane contact line Y. Accordingly, a compression exhaustion section 2021 in communication with the gas outlet 204 is formed on a front side of the vane 14 in a rotational advancing direction of the vane 14 and an intake section 2022 in communication with the gas inlet 205 is formed on a rear side of the vane 14 in a direction reverse to the rotational advancing direction of the vane 14.

When the external power supply via the transmission member 15 drives the second rotor shaft 12 to make the vane rotor 1 rotate, the vane 14 in the vane slot 13 of the vane rotor 1 is driven and rotated along with the rotation of the vane rotor 1. At this time, the vane pivotally connecting sections 141 of the vane 14 drive the vane pivotally connected section 207 and the subsidiary vane pivotally connected section 212 of the cylinder 2, whereby the cylinder 2 is rotated around the shaft seat 302 and the subsidiary shaft seat 311 of the main seat 3 in the same rotational direction as the vane rotor 1. However, the rotational axis of the cylinder 2 is eccentric from the rotational axis of the vane rotor 1. At the same time, under the limitation of the pivotal connection track of the cylinder 2, which is eccentrically rotated relative to the vane rotor 1, the vane 14 is reciprocally telescopically slid within the vane slot 13 along with the rotation of the vane rotor 1. When the vane 14 is reciprocally telescopically slid within the vane slot 13, the vane 14 is swung with its top end always tightly abutting against a fixed position of the inner circumferential wall 203 of the cylinder 2. Therefore, during the compression process, the vane 14 will not be retracted back into the vane slot 13 due to excessively great pressure of the internal gas to make a gap and lead to insufficient gas density.

Figure 7:
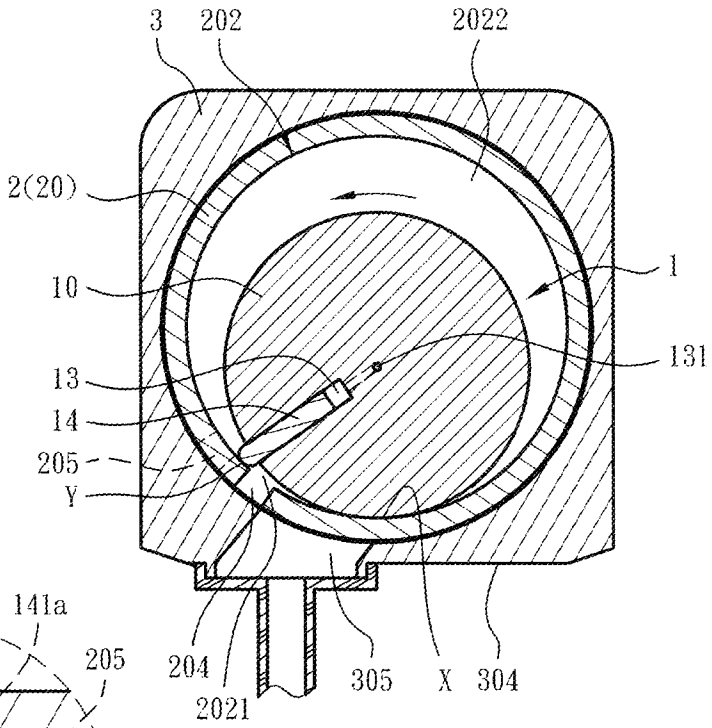
FIG. 7 is a cross-sectional view of the first embodiment of the present invention, showing that the cylinder and the vane are situated in a state after the gas is compressed and before the gas is exhausted.
Figure 6:
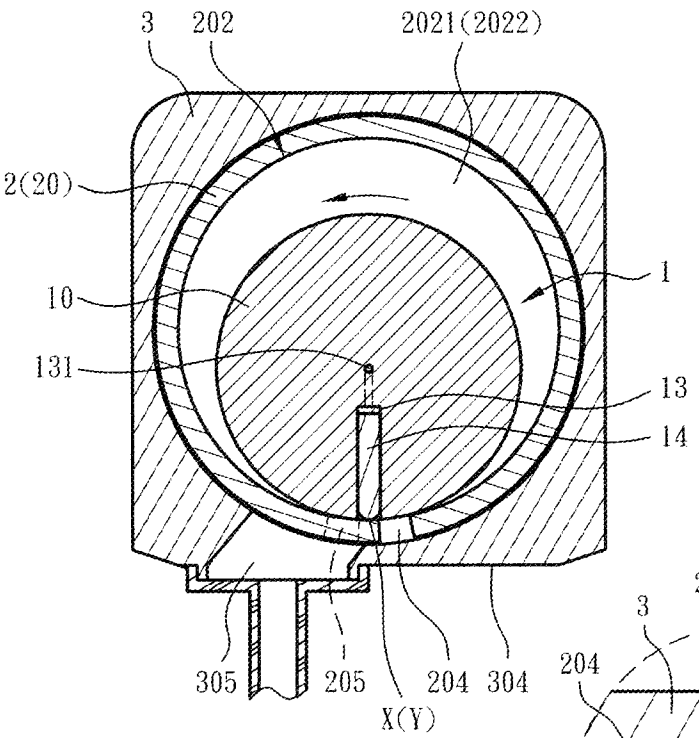
FIG. 6 is a cross-sectional view of the first embodiment of the present invention, showing that the cylinder and the vane are situated in an initial state of gas compression and intake.

In the above operation and driving process, when the vane 14 and the cylinder 2 are moved to the position as shown in FIG. 6, the axial vane contact line Y defined by the vane 14 just coincides with the axial partitioning line X. Under such circumstance, the space of the vane chamber 202, (that is, the intake section 2022) rearward clockwise from the axial vane contact line Y defined by the vane 14 to the axial partitioning line X is minimal, while the space of the vane chamber 202, (that is, the compression exhaustion section 2021) forward counterclockwise from the axial vane contact line Y defined by the vane 14 to the axial partitioning line X is maximal. At this time, the compression travel is in an initial zeroed state. When the vane rotor 1 further (counterclockwise) rotates, the axial vane contact line Y defined by the vane 14 passes over the axial partitioning line X. Thereafter, the intake section 2022 is gradually enlarged, (that is, the gas is continuously taken in) and the compression exhaustion section 2021 is gradually minified from the aforesaid maximal state, (that is, the gas is continuously compressed) until the gas outlet 204 of the cylinder 2 reaches the position as shown in FIG. 7. At this time, the gas outlet 204 is gradually in communication with the out-guiding hole 305 of the main seat 3, whereby the compressed gas in the compression exhaustion section 2021 starts to be exhausted from the out-guiding hole 305 until the axial vane contact line Y defined by the vane 14 again coincides with the axial partitioning line X. Accordingly, the gas intake, compression and exhaustion travels are accomplished step by step. That is, when the axial vane contact line Y defined by the vane 14 coincides with the axial partitioning line X, the intake section 2022 is equal to the space of the entire vane chamber 202 (the largest space) and the compression exhaustion section 2021 is minimal and the compressed gas in the compression exhaustion section 2021 is just totally exhausted. The transition between the intake travel and the compression travel is a start of new compression circulation. Accordingly, the compression circulation is repeated to achieve the effect of a compressor.

Figure 8:
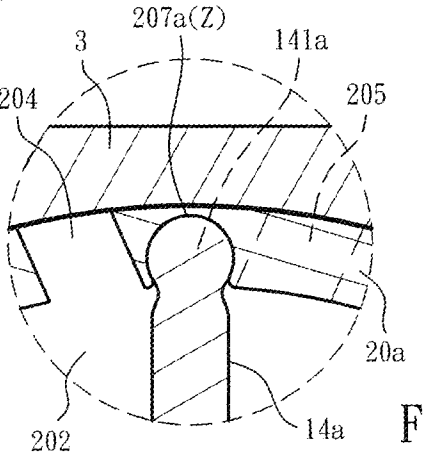
FIG. 8 is an enlarged view of the first embodiment of the present invention, showing that the top end of the vane is inlaid in the inner circumferential wall of the cylinder.

In a preferred embodiment, in order to achieve better contact sealing effect between the vane 14 and the cylinder 20, the top end of the vane 14 tightly abut against the inner circumferential wall 203 of the cylinder main body 20 along the axial vane contact line Y. Alternatively, the top end of the vane 14 can be inlaid in the cylinder main body 20 as shown in FIG. 8. The top end of the vane 14*a* between the two vane pivotally connecting sections 141*a* is inlaid in a vane inlay channel 207*a* of the cylinder main body 20*a* to define an axial vane contact arc Z.

Figure 9:
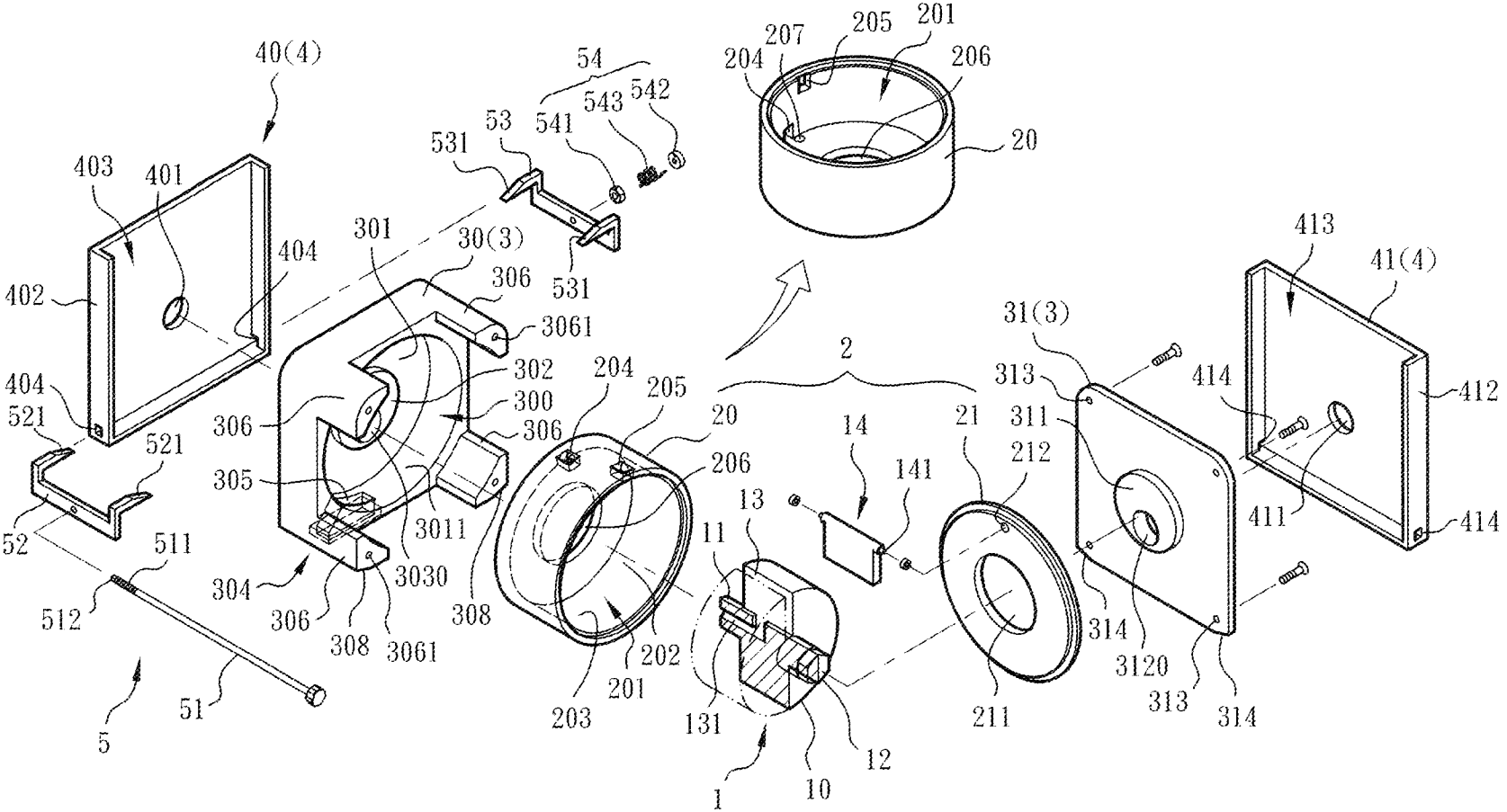
FIG. 9 is a perspective exploded view of a second embodiment of the present invention.
Figure 10:
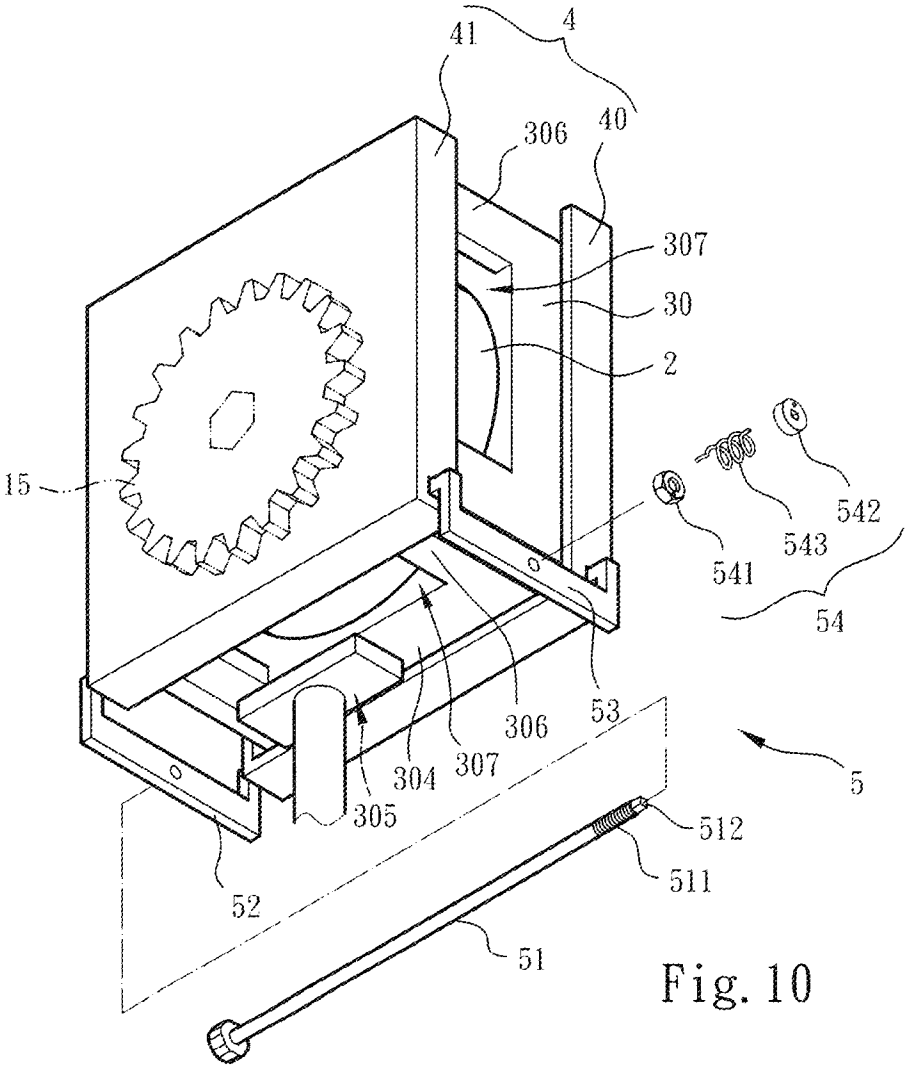
FIG. 10 is a perspective partially exploded view of the second embodiment of the present invention, seen from the bottom side.
Figure 11:
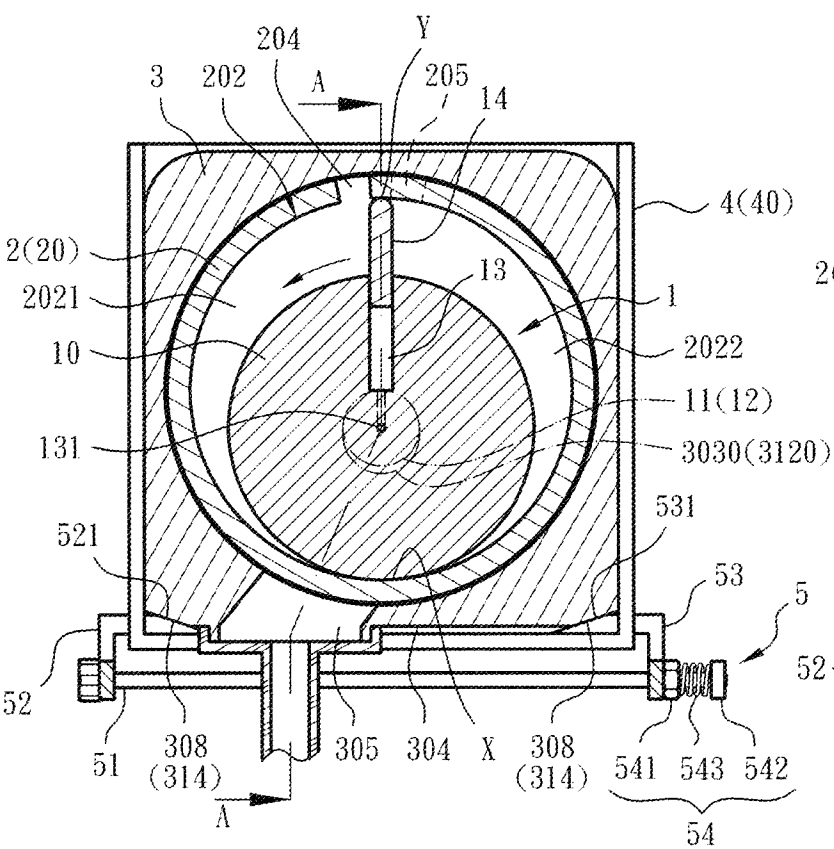
FIG. 11 is a cross-sectional view of the vane rotor of the second embodiment of the present invention, which is taken along line B-B of FIG. 5 to show the structure of the second embodiment of present invention.
Figure 13:
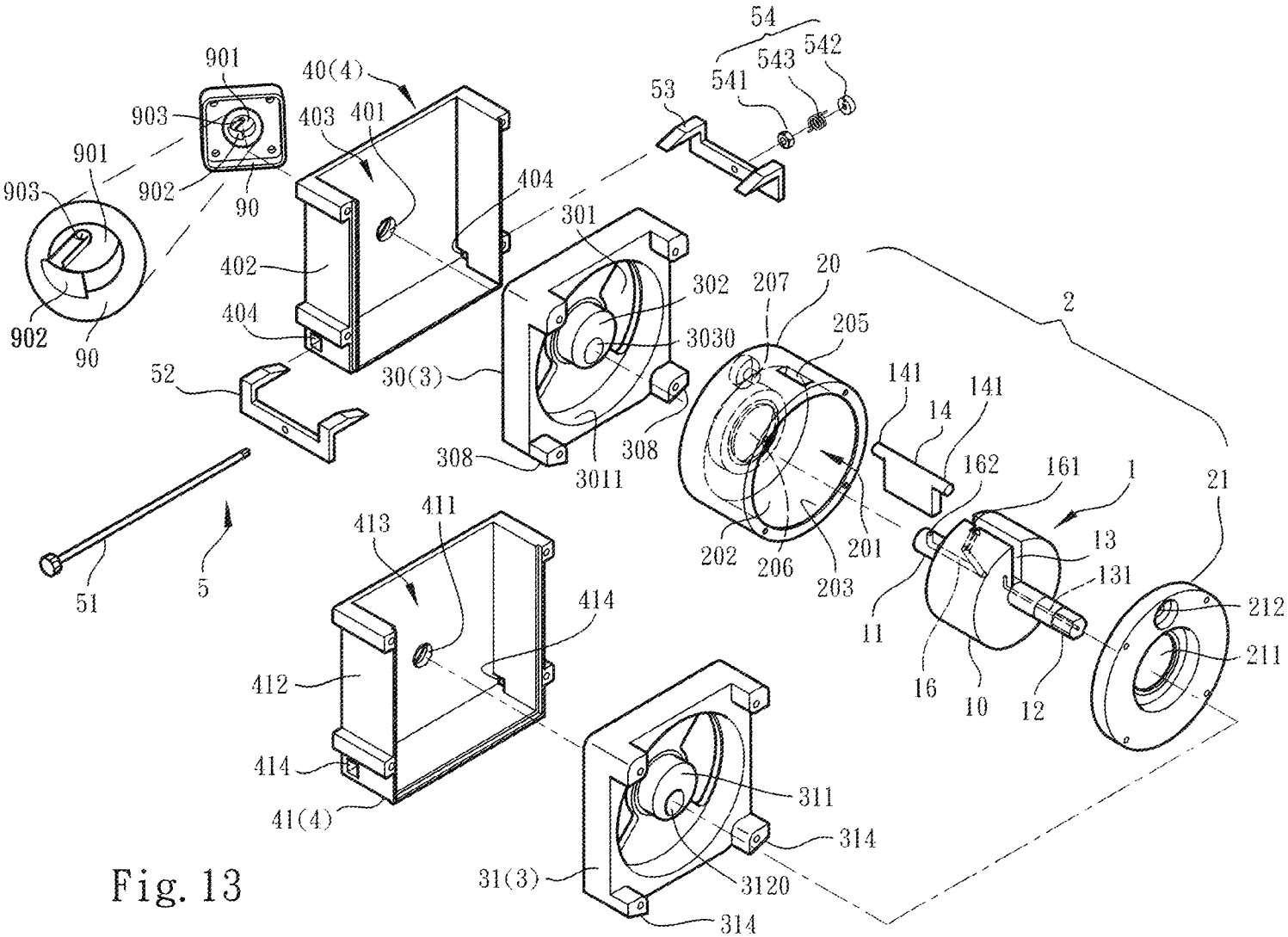
FIG. 13 is a perspective exploded view of a fourth embodiment of the present invention.
Figure 15:
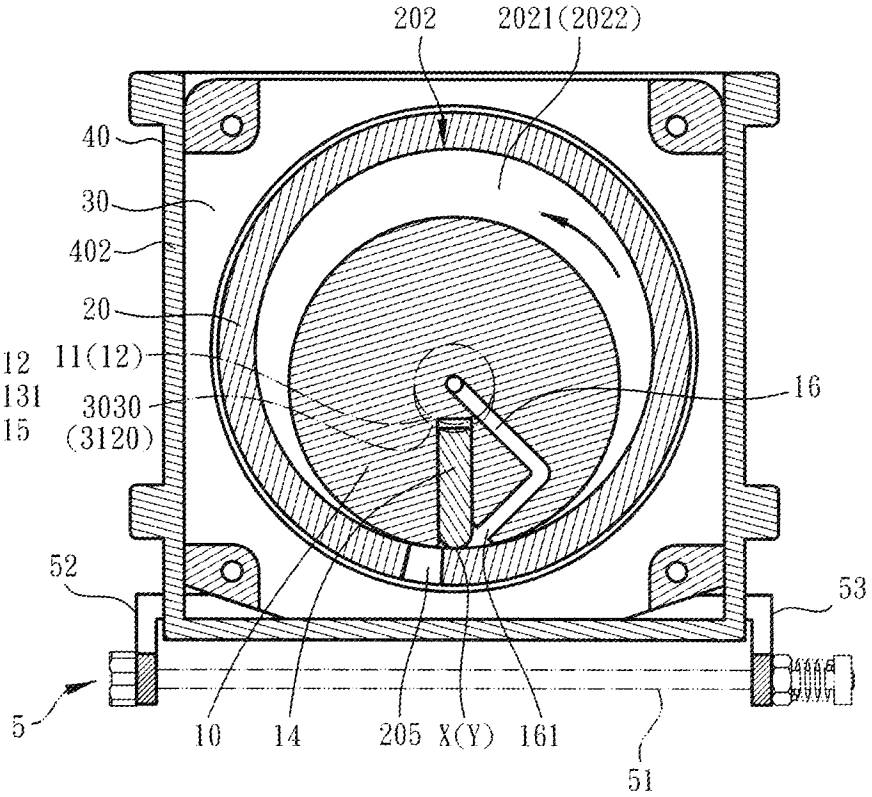
FIG. 15 is a cross-sectional view of the fourth embodiment of the present invention, which is taken along line D-D of FIG. 14 to show that the cylinder and the vane are situated in an initial state of gas compression and intake.
Figure 14:
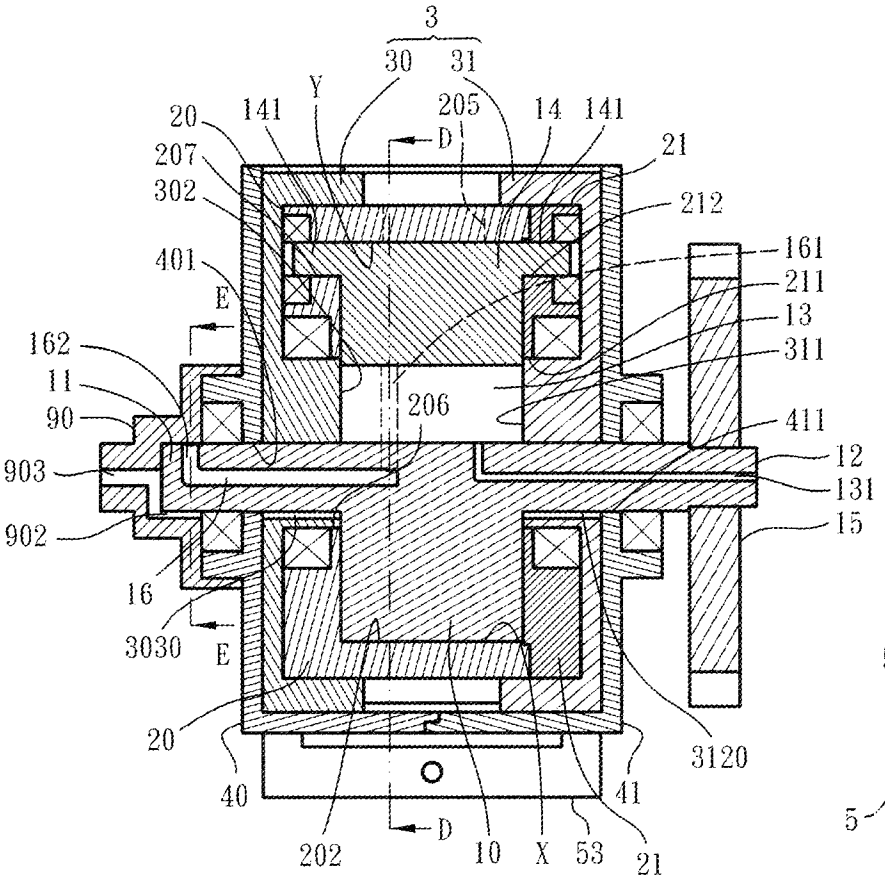
FIG. 14 is a longitudinally sectional view of the vane rotor of the fourth embodiment of the present invention, showing the completely assembled structure of the fourth embodiment of present invention.
Figure 15A:
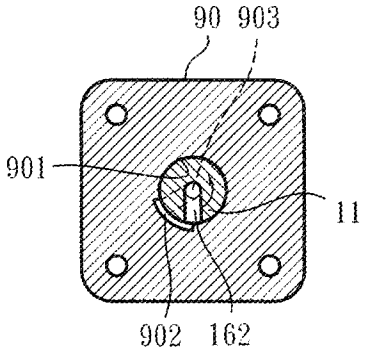
FIG. 15A is a cross-sectional view of the fourth embodiment of the present invention, which is taken along line E-E of FIG. 14 to show the position of the rotor shaft in the rotor shaft socket of the shaft end gas exhaustion control assembly with the cylinder and the vane situated in the positions as shown in FIG. 15.

Please now refer to FIGS. 9 to 11. According to a second embodiment, the compressor structure of the present invention includes a vane rotor 1, a cylinder 2, a main seat 3, a support body assembly 4 and an automatic adjustment assembly 5. The vane rotor 1, the cylinder 2 and the main seat 3 are substantially identical to the first embodiment and are only different from the first embodiment in that two ends of an outer periphery of the main seat main body 30 are respectively formed with two guide slopes 308 and two ends of an outer periphery of the main seat subsidiary body 31 are respectively-formed with two guide slopes 314 for cooperatively assembling with the support body assembly 4 and the automatic adjustment assembly 5. In addition, the eccentric circular shaft hole 303 and the subsidiary eccentric circular shaft hole 312 of the first embodiment are replaced with an eccentric elliptic shaft hole 3030 and a subsidiary eccentric elliptic shaft hole 3120 (as shown by the phantom lines of FIG. 11). The second embodiment is based on the first embodiment and the support body assembly 4 and the automatic adjustment assembly 5 are additionally assembled with the first embodiment to form the second embodiment.

The support body assembly 4 is composed of a first support body 40 and a second support body 41 respectively disposed on outer sides of the main seat main body 30 and the main seat subsidiary body 31. Each of the first and second support bodies 40, 41 is formed with a rotor shaft end hole 401, 411 respectively corresponding to the eccentric elliptic shaft hole 3030 and the subsidiary eccentric elliptic shaft hole 3120 of the main seat 3. Accordingly, the first rotor shaft 11 and the second rotor shaft 12 of the vane rotor 1 can be passed through the eccentric elliptic shaft hole 3030 and the subsidiary eccentric elliptic shaft hole 3120 and pivotally fitted in the rotor shaft end holes 401, 411, whereby the vane rotor 1 is pivotally rotatably supported on the support body assembly 4.

A periphery of the first support body 40 and a periphery of the second support body 41 are formed with lateral bent edges 402, 412 directed to the main seat main body 30 and the main seat subsidiary body 31. The lateral bent edges 402, 412 define openings 403, 413. Lateral perforations 404, 414 are respectively formed on the lateral bent edges 402, 412 in positions corresponding to the guide slopes 308, 314 of the main seat 3.

The automatic adjustment assembly 5 can be mounted at the lateral perforations 404, 414 of the lateral bent edges 402, 412. The automatic adjustment assembly 5 is disposed on two lateral sides of the support body assembly 4 for adjusting and eliminating the gap between the circumferential wall of the vane impeller 10 of the vane rotor 1 and the inner circumferential wall 203 of the vane chamber 202, which gap is produced due to wear in operation. The eccentric elliptic shaft hole 3030 of the main seat main body 30 and the subsidiary eccentric elliptic shaft hole 3120 of the main seat subsidiary body 31 are formed as elongated elliptic holes in adaptation to the installation of the automatic adjustment assembly 5. The direction of the long axis of the elongated elliptic hole corresponds to the displacement direction of the gap between the circumferential wall of the vane impeller 10 of the vane rotor 1 and the inner circumferential wall 203 of the vane chamber 202, which is adjusted by the automatic adjustment assembly 5. Moreover, the short axis of the elongated elliptic hole is equal to the diameter of the first rotor shaft 11 and the second rotor shaft 12 of the vane rotor, whereby the track of the gap can be stably adjusted.

In this embodiment, the automatic adjustment assembly 5 has a shaft rod 51, two fastening members 52, 53 and an elastic adjustment member 54. The two fastening members 52, 53 are respectively passed through the lateral perforations 404, 414 of the two symmetrical lateral bent edges 402, 412 and fitted on the shaft rod 51 toward each other. A rear end of the shaft rod 51 is formed with a self-tapping threaded section 511. A tail end of the self-tapping threaded section 511 is formed with a polygonal cross-sectional section 512. The elastic adjustment member 54 includes a self-tapping nut 541 screwed on the self-tapping threaded section 511, a tail-end retainer member 542 securely fitted on the polygonal cross-sectional section 512 and a torque spring 543 assembled between the self-tapping nut 541 and the tail-end retainer member 542 by a preset torque. Two ends of the torque spring 543 are respectively fixed on the self-tapping nut 541 and the tail-end retainer member 542, whereby by means of the automatically elastically twisting effect of the self-tapping nut 541 of the elastic adjustment member 54, the two fastening members 52, 53 can automatically get close to the main seat main body 30 and the main seat subsidiary body 31. In this case, fastening slopes 521, 531 of the two fastening members 52, 53 can get close to the main seat main body 30 and the main seat subsidiary body 31 to force the guide slopes 308, 314 of the main seal 3 from two sides, whereby the fastening slopes 521, 531 always apply a lifting force to the guide slopes 308, 314. Under such circumstance, the main seat 3 is forced to drive the cylinder 2 to move in a direction toward the circumferential wall of the vane impeller 10 of the vane rotor 1 so as to tightly attach to the circumferential wall of the vane impeller 10. Therefore, the gap between the circumferential wall of the vane impeller 10 and the inner circumferential wall 203 of the vane chamber 202, which gap is produced due to wear can be automatically adjusted and eliminated.

Figure 12:
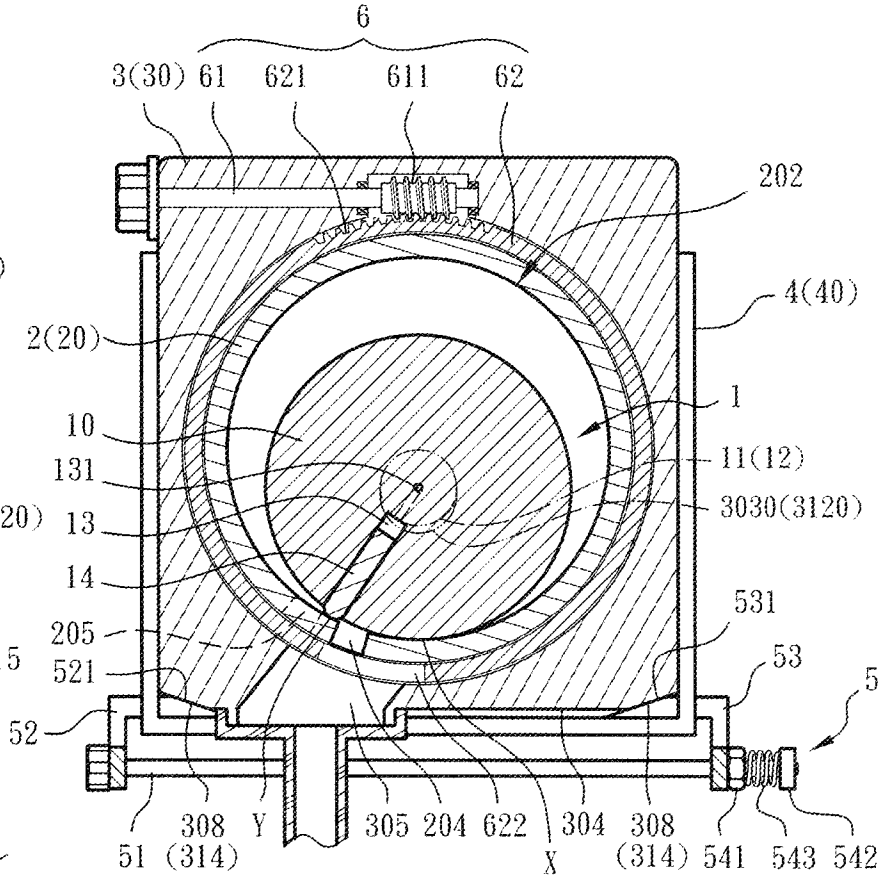
FIG. 12 is a cross-sectional assembled view of a third embodiment of the present invention.

Please now refer to FIG. 12. According to a third embodiment, the compressor structure of the present invention includes a vane rotor 1, a cylinder 2, a main seat 3, a support body assembly 4 and an automatic adjustment assembly 5, which are assembled in the same manner as the second embodiment. The third embodiment further includes a compression ratio regulation assembly 6. The compression ratio regulation assembly 6 includes a regulation rod 61 and a regulation member 62. The regulation member 62 is pivotally rotatably fitted between the outer circumference of the cylinder 2 and the cylinder receiving chamber 301 of the main seat 3. A driven section 621 and a regulation opening 622 are disposed on an outer circumference of the regulation member 62. The driven section 621 can be multiple teeth uniformly arranged in a row. The regulation opening 622 keeps partially overlapping with the out-guiding hole 305 of the main seat 3.

The regulation rod 61 extends from outer side into the main seat 3. An end section of the regulation rod 61 is formed with a driving sect ion 611 engaged with the driven section 621. The driving section 611 is an outer thread, which can be engaged with the driven section 621 (teeth arranged in a row). In a preferred embodiment, one end of the regulation rod 61 is exposed to outer side of the main seat 3 and additionally connected with an electronic mechanism capable of driving the regulation rod 61 to rotate so as to achieve strength-saving and fast operation function.

In the above structure, an operator can drive the regulation rod 61 to rotate from outer side. The driving section 611 of the regulation rod 61 is engaged with the driven section 621 of the regulation member 62 so that the regulation member 62 can be rotated clockwise or counterclockwise to change the overlapping start posit ion of the regulation opening 622 and the out-guiding hole 305 so as to adjust the timing for the gas outlet 204 of the cylinder 2 to guide out the compressed gas. Accordingly, the compression ratio of the output gas can be real-time adjusted.

Please now refer to FIGS. 13 to 17, which show a fourth embodiment of the compressor structure of the present invention. The fourth embodiment is based on the second embodiment and is different from the second embodiment in that the gas outlet 204 is alternatively disposed on the vane rotor 1 instead of the circumferential wall of the cylinder main body 20 and the gas is exhausted through the first rotor shaft 11. In addition, the out-guiding hole 305 originally disposed on the main seat main body 30 for controlling the gas compression ratio in the second embodiment is replaced with a shaft end gas exhaustion control assembly 90 for controlling the exhaustion of the compressed gas through the first rotor shaft 11. Except the above two modifications, the other structure, assembly and operation of the fourth embodiment are identical to the second embodiment. Therefore, the fourth embodiment of the compressor structure of the present invention includes a vane rotor 1, a cylinder 2, a main seat 3, a support body assembly 4, an automatic adjustment assembly 5 and a shaft end gas exhaustion control assembly 90. The vane rotor 1 of the fourth embodiment is substantially identical to the vane rotor 1 of the second embodiment and is only different from the vane rotor 1 of the second embodiment in that a gas exhaustion passage 16 is additionally formed inside the vane rotor 1. One end of the gas exhaustion passage 16 is in communication with a gas outlet 161 formed at a junction between the vane impeller 10 and the vane slot 13 in the advancing direction of the vane 14. The other end of the gas exhaustion passage 16 is in communication with a gas exhaustion port 162 formed on the first rotor shaft 11 instead of the gas out let 204 of the second embodiment to provide the same function. In addition, the cylinder 2 of the fourth embodiment is different from the cylinder 2 of the second embodiment in that the gas outlet 204 of the second embodiment is eliminated. The other structures of the fourth embodiment are all identical to the second embodiment.

In this embodiment, the shaft end gas exhaustion control assembly 90 is disposed on outer side of the first support body 40 (or the second support body 41) of the support body assembly 4. A rotor shaft socket 901 is formed at a center of the shaft end gas exhaustion control assembly 90. The rotor shaft socket 901 is sealedly capped on an end section of the first rotor shaft 11 (or the second rotor shaft 12) with the gas exhaustion port 162. A part of a circumference of the rotor shaft socket 901 is formed with an out-guiding notch 902 in communication with a gas exhaustion port 903 formed on the shaft end gas exhaustion control assembly 90 in communication with outer side of the shaft end gas exhaustion control assembly 90 for exhausting the gas.

Figure 16A:
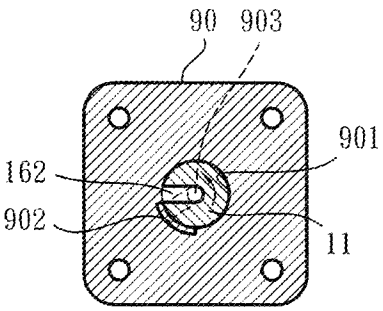
FIG. 16A is a cross-sectional view of the fourth embodiment of the present invention, which is taken along line E-E of FIG. 14 to show the position of the rotor shaft in the rotor shaft socket of the shaft end gas exhaustion control assembly with the cylinder and the vane situated in the positions as shown in FIG. 16.

The gas exhaustion port 162 at the end section of the first rotor shaft 11 of the fourth embodiment provides the same function in compressor operation as the gas outlet 204 of the second embodiment. Also, the out-guiding notch 902 of the shaft end gas exhaustion control assembly 90 of the fourth embodiment provides the same function in compressor operation as the out-guiding hole 305 of the second embodiment. In operation of the compressor of the fourth embodiment, the compressed air goes from the gas outlet 161 of the vane rotor 1 through the gas exhaustion passage 16 to be exhausted to outer side from the gas exhaustion port 162 of the end section of the first rotor shaft 11. When the gas exhaustion port 162 of the end section of the first rotor shaft 11 starts to overlap with the out-guiding notch 902 of the shaft end gas exhaustion control assembly 90 (with reference to FIGS. 16 and 16A), the compressed air goes through the out-guiding notch 902 to be exhausted to outer side of the compressor from the gas exhaustion port 903.

Figure 17:
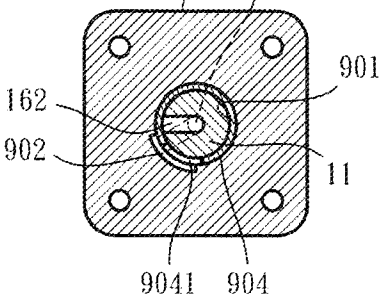
FIG. 17 is a cross-sectional view of the fourth embodiment of the present invention, showing that a compression ratio regulation assembly with compression ratio adjustment function is additionally disposed between the shaft end gas exhaustion control assembly and the end section of the rotor shaft.
Figure 16:
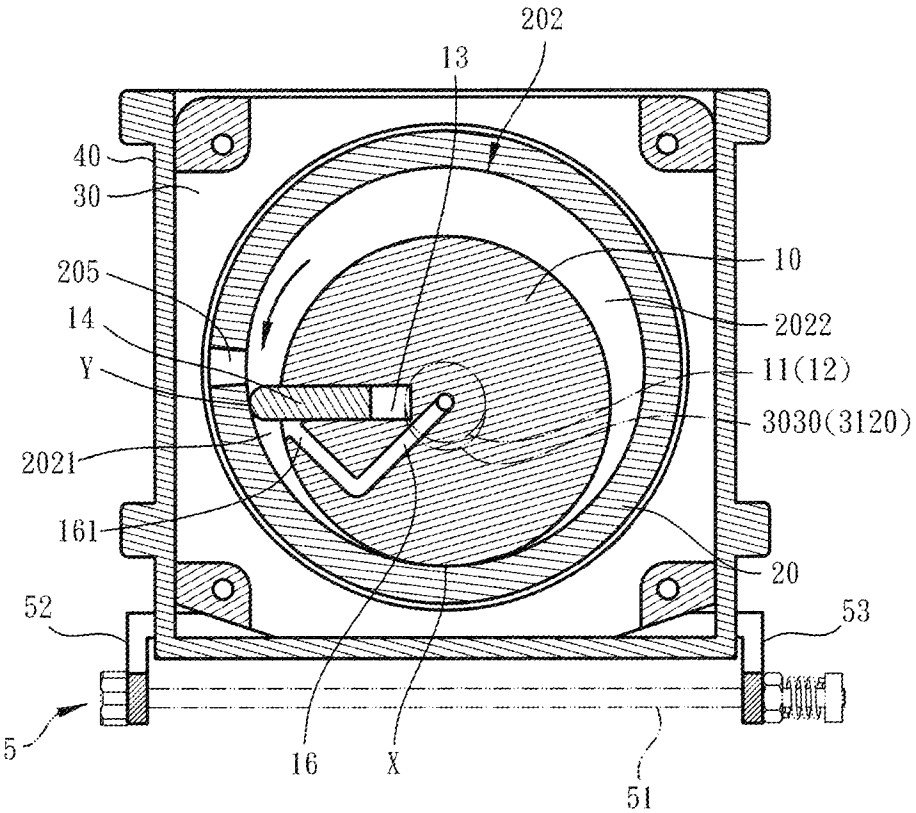
FIG. 16 is a cross-sectional view of the fourth embodiment of the present invention, which is taken along line D-D of FIG. 14 to show that the cylinder and the vane are situated in a state in which the compressed gas is exhausted.
Figure 18:
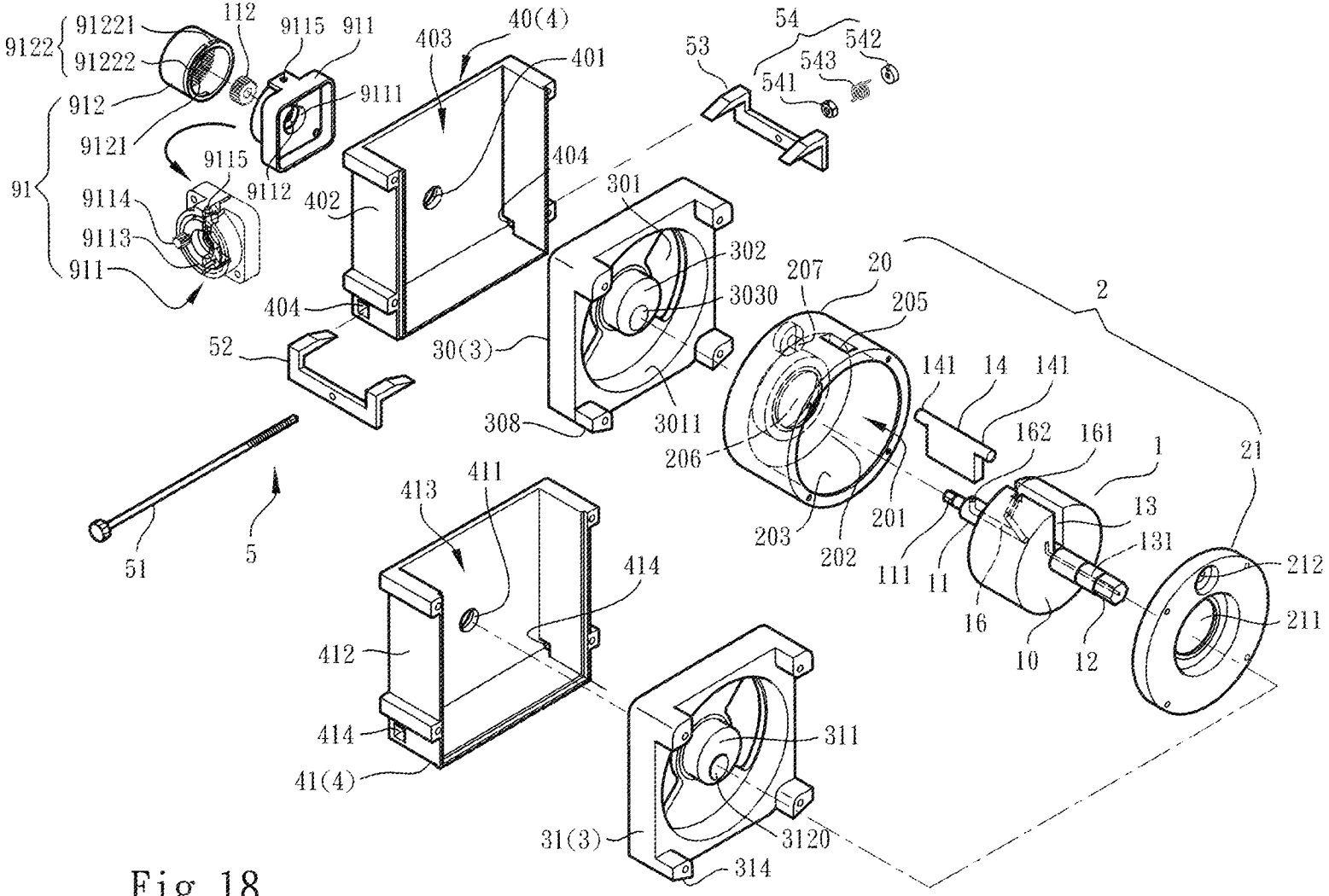
FIG. 18 is a perspective exploded view of a fifth embodiment of the present invention.
Figure 20:
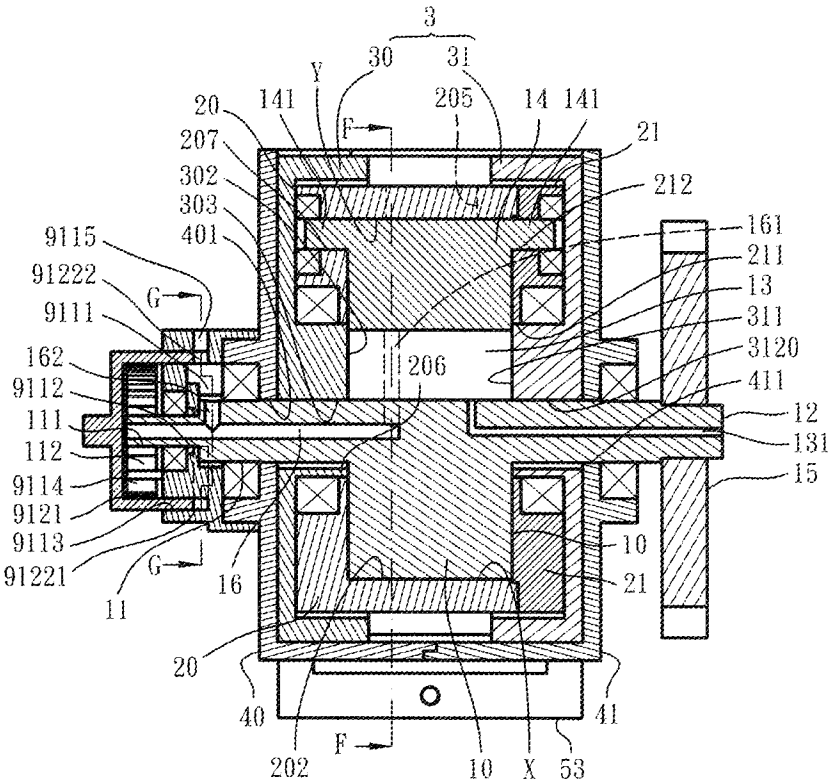
FIG. 20 is a longitudinally sectional view of the vane rotor of the fifth embodiment of the present invention, showing the completely assembled structure of the fifth embodiment of present invention.
Figure 19:
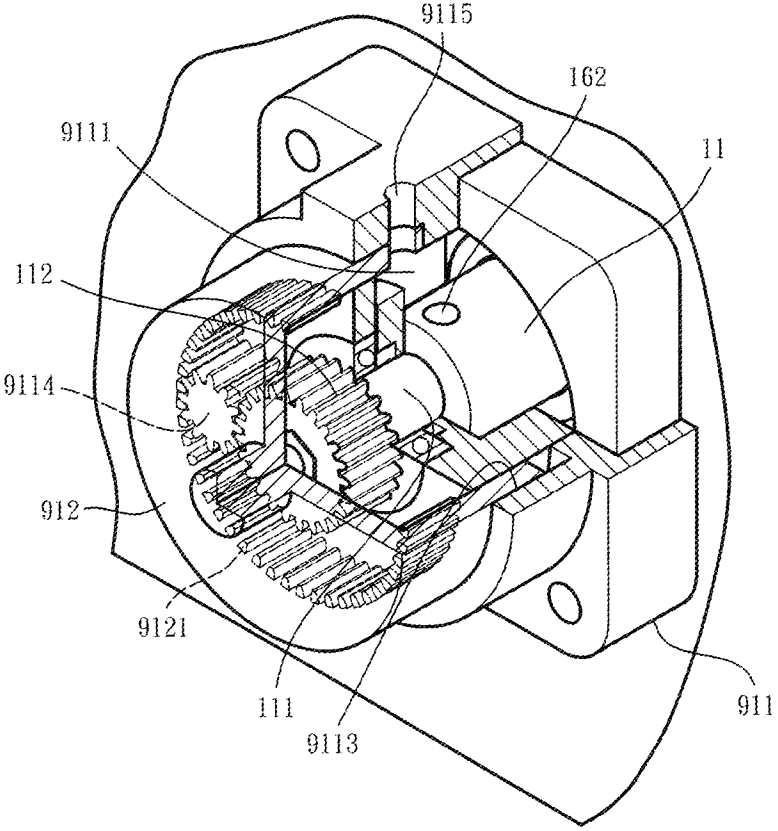
FIG. 19 is a perspective assembled partially sectional view of the fifth embodiment of the present invention.

Please now refer to FIG. 17. According to the above structure, a compression ratio regulation assembly 904 can be additionally fitted between inner circumference of the rotor shaft socket 901 of the shaft end gas exhaustion control assembly 90 and outer circumference of the first rotor shaft 11. The compression ratio regulation assembly 904 has a regulation opening 9041 in the moving path of the gas exhaustion port 162. A drive mechanism (not shown) is used to drive the compression ratio regulation assembly 904 to rotate and make the regulation opening 9041 change the overlapping position with the out-guiding notch 902 so as to change the liming for the gas exhaustion port 162 to guide out the air. Accordingly, in the precondition that the shaft end gas exhaustion control assembly 90 is not replaced, the same operation effect of adjustment of air compression ratio can be achieved. The compression ratio regulation assembly 904 has the same function as the compression ratio regulation assembly 6 of the third embodiment (with reference to FIG. 12).

Please now refer to FIGS. 18 to 22, which show a fifth embodiment of the compressor structure of the present invention. The fifth embodiment is based on the fourth embodiment and is different from the fourth embodiment in that the first rotor shaft 11 of the vane rotor 1 additionally has a connection section Ml and a linking member 112 fit ted on the connect ion sect ion 111. Moreover, the shaft end gas exhaustion control assembly 90 of the fourth embodiment is replaced with a shaft end gas exhaust ion control assembly 91. Except the above two modifications, the other structure, assembly and operation of the fifth embodiment are identical to the fourth embodiment. Therefore, the fifth embodiment of the compressor structure of the present invention includes a vane rotor 1, a cylinder 2, a main seat 3, a support body assembly 4, an automatic adjustment assembly 5 and a shaft end gas exhaustion control assembly 91.

In this embodiment, the shaft end gas exhaustion control assembly 91 is composed of an end cap seat 911 and an out-guiding notch control ring cap 912 with an opening. The end cap seat 911 is disposed on outer side of the first support body 40 (or the second support body 41) of the support body assembly 4. A rotor shaft socket 9111 is formed on an inner side of the end cap seat 911 for fitting with the end section of the first rotor shaft 11 (or the second rotor shaft 12). A central hole 9112 is formed at a center of the rotor shaft socket 9111 through the end cap seat 911 for the connection section 111 of the end section of the first rotor shaft 11 to extend through. In addition, an annular groove 9113 is formed on the end cap seat 911 concentrically around the central hole 9112. A subsidiary linking member 9114 (such as a linking gear) is disposed between the central hole 9112 and the annular groove 9113. The subsidiary linking member 9114 (linking gear) is connected (engaged) with the linking member 112 (driving gear). In addition, a first through hole 9115 is formed on the end cap seat 911. The through hole

9115 passes through the annular groove 9113 in communication with the rotor shaft socket 911.

A rim of the open end of the out-guiding notch control ring cap 912 is inlaid in the annular groove 9113 of the end cap seat 911. A driven section 9121 (such as an inner toothed ring) is annularly disposed on an inner circumferential wall of the out-guiding notch control ring cap 912. The driven section 9121 (inner toothed ring) is connected (engaged) with the subsidiary linking member 9114 (linking gear), whereby the out-guiding notch control ring cap 912 can via the linking member 112 (driving gear) first drive the subsidiary linking member 9114 (linking gear) and then indirectly drive the driven section 9121 to pivotally rotate. In this embodiment, the rim of the out-guiding notch control ring cap 912 that is inlaid in the annular groove 9113 is formed with a first annular rail 9122. A first notch segment 91221 and a second notch segment 91222 are disposed on the first annular rail 9122. In addition, the first annular rail 9112 and the first through hole 9115 of the end cap seat 911 are positioned in the same axial position. When the out-guiding notch control ring cap 912 is driven by the linking member 112 to pivotally rotate, the first notch segment 91221 and the second notch segment 91222 on the first annular rail 9122 will both pass through the first through hole 9115 to overlap and communicate with the first through hole 9115.

In the operation of the compressor, each time period for each of the first notch segment 91221 and the second notch segment 91222 to pass through the first through hole 9115 just corresponds to one-cycle rotation of the compressor. Therefore, one-cycle rotation of the first annular rail 9122 is equivalent to two-cycle rotation of the vane rotor 1. In addition, the rotation is transmitted through the subsidiary linking member 9114 so that the rotational direction of the first annular rail 9112 is reverse to the rotational direction of the vane rotor 1, that is, in operation, the ratio of the rotational speed of the linking member 112 (driving gear) to the rotational speed of the driven section 9121 (inner toothed ring) is 2:1. In the case that there are three notch segments disposed on the first annular rail 9122, the ratio of the rotational speed of the linking member 112 to the rotational speed of the driven section 9121 is 3:1, and so on.

Figure 21D:
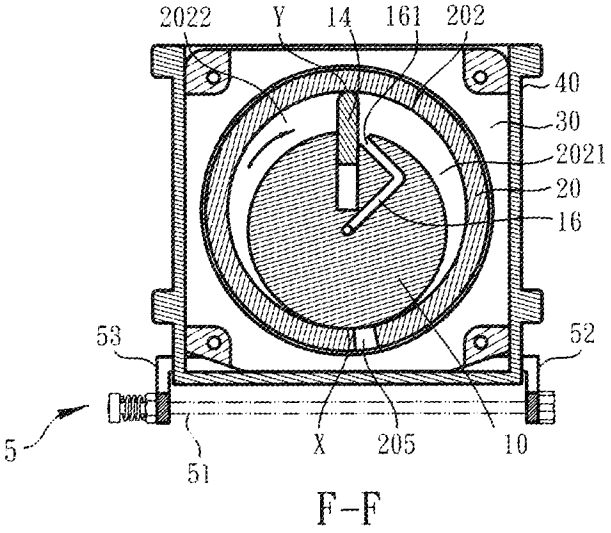
FIG. 21D is a cross-sectional view of the fifth embodiment of the present invention, which is taken along line F-F and line G-G of FIG. 20 to show that the compressor is situated at a middle stage of the corresponding operation of the second notch segment of the first annular rail.
Figure 21D:
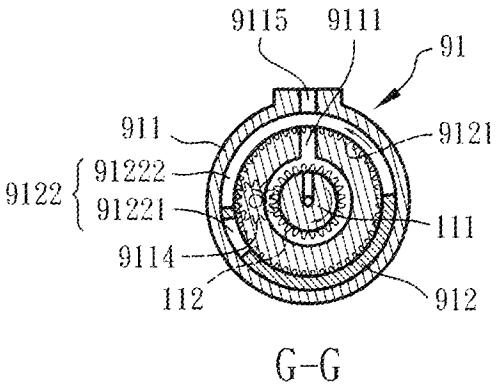
Figure 21E:
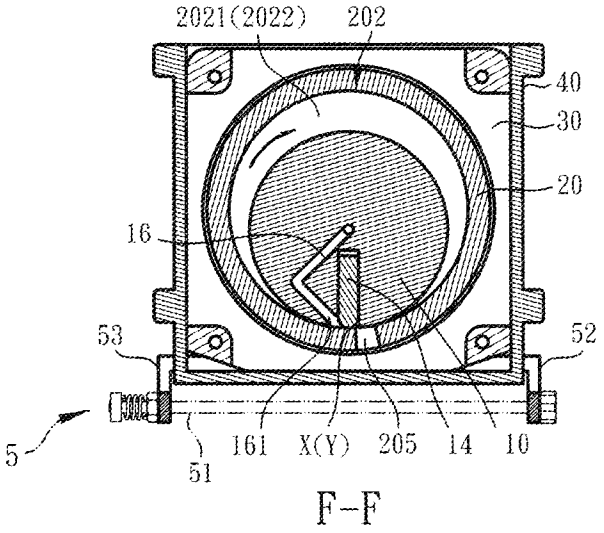
FIG. 21E is a cross-sectional view of the fifth embodiment of the present invention, which is taker, along line F-F and line G-G of FIG. 20 to show that the compressor is situated at a finished stage of the corresponding operation of the second notch segment of the first annular rail, that is, situated at an initial stage of the next corresponding operation of the first notch segment.
Figure 21E:
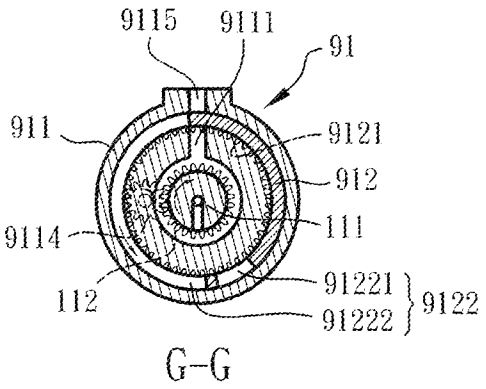

In operation of the fifth embodiment of the compressor structure of the present invention, the compressed air of the vane chamber 202 goes from the gas outlet 161 of the vane rotor 1 through the gas exhaustion passage 16 and the gas exhaustion port 162 of the end section of the first rotor shaft 11 into the interval space defined between the first rotor shaft 11 and the rotor shaft socket 9111 of the end cap seat 911. Then the compressed air goes through the first annular rail 9122 in the annular groove 9113 to be exhausted to outer side in a direction to the first through hole 9115. In the case that any notch part of the notch segments on the first annular rail 9122 overlaps and communicates with the first through hole 9115, the compressed gas is exhausted out of the compressor. If not, the compressor is situated at an air compression stage. FIG. 21A shows that the compressor is situated at an initial compression stage, wherein the corresponding operation of the first notch segment 91221 starts. FIG. 21B shows that the compressor enters a final gas compression stage. During the operation period from the initial compression stage of FIG. 21A to this stage, the first notch segment 91221 passes through the first through hole 9115, but no notches overlap and communicate therewith. However, after that, the notch part of the first notch segment 91221 is about to overlap and communicate with the first through hole 9115 to enter the compression exhaustion state. FIG. 21C shows that the compressor starts to enter the exhaustion completion stage. During the period from the stage of FIG. 21B to the stage of FIG. 21C, the notch part of the first notch segment 91221 overlaps and communicates with the first through hole 9115 to exhaust the compressed air. After the exhaustion is completed, the first notch segment 91221 finishes the corresponding compression operation. At the same time, the second notch segment 91222 starts to enter the corresponding operation. FIGS. 21D and 21E show that the compressor is situated at the operation corresponding to the second notch segment 91222. The second notch segment 91222 is entirely a notch in communication with the first through hole 9115 so that the compressor is situated in an uncompressed state, in which the gas is continuously exhausted so that the compressor serves as a pump, it can be known from the contents of FIG. 21A and FIG. 21E that the contents of the two drawings are totally identical to each other. This means that the stage of completion of the operation of the second notch segment 91222 is exactly the next initial operation stage of the first notch segment 91221. Accordingly, the compressor is continuously alternately switched between operations to continuously circularly operate.

Figure 22:
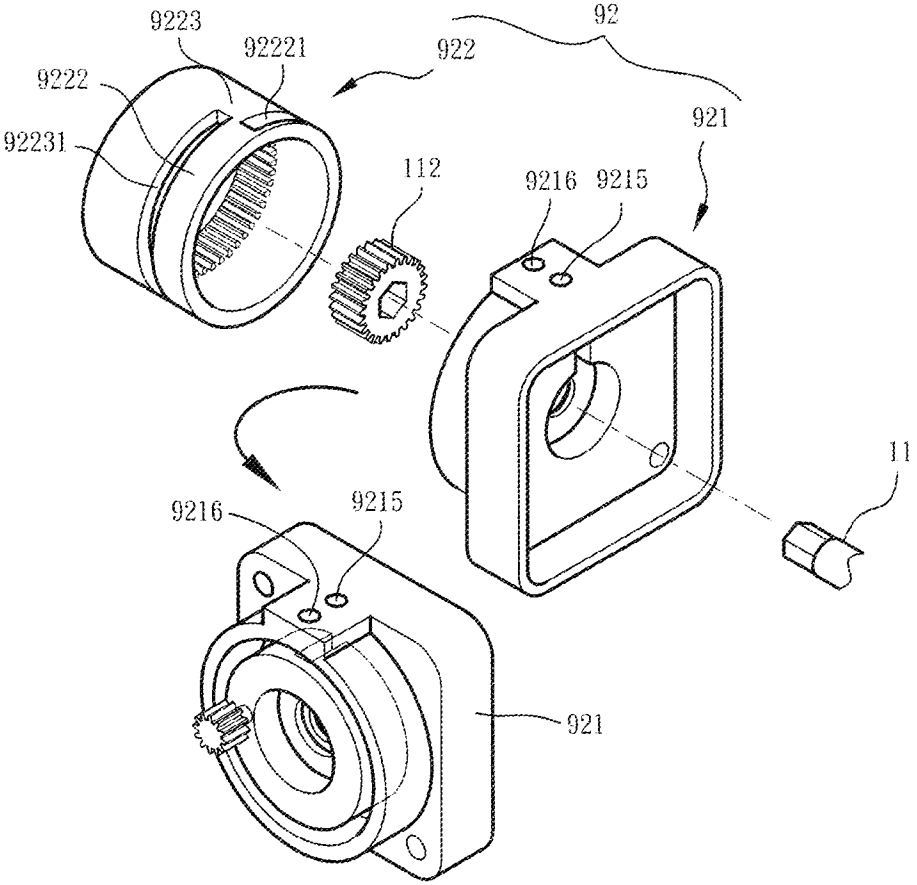
FIG. 22 is a perspective exploded view of another aspect of the fifth embodiment of the present invention, showing that the shaft end gas exhaustion control assembly is formed with multiple annular rails.

The aforesaid first annular rail 9122 has two notch segments. However, the gas is all exhausted from the first through hole 9115 so that it is uneasy to distinguish the exhausted gas for respective use. Therefore, the first notch segment 91221 and the second notch segment 91222 of the first annular rail 9122 of the out-guiding notch control ring cap 912 can be dismantled into the out-guiding notch control ring cap 922 as shown in FIG. 22. That is, the first notch segment 91221 of the original first annular rail 9122 is dismantled into a corresponding first notch segment 92221 of a first annular rail 9222 and the second notch segment 91222 of the original first annular rail 9122 is dismantled into a corresponding first notch segment 92231 of a second annular rail 9223. In addition, the end cap seat 911 is replaced with an end cap seat 921. The end cap seat 921 is formed with a first through hole 9215 identical to and corresponding to the original first through hole 9115 and an additional second through hole 9216. The other structures of the end cap seat 921 are all identical to those of the end cap seat 911. Accordingly, the gas exhausted from the first notch segment 92221 of the first annular rail 9222 is exhausted from the first through hole 9215, while the gas exhausted from the first notch segment 92231 of the second annular rail 9223 is exhausted from the second through hole 9216 to facilitate successive application. In the case that the first annular rail 9122 is formed with three notch segments, the first annular rail 9122 can be dismantled into three corresponding annular rails, and so on.

The fourth and fifth embodiments are both based on the structure of the second embodiment. In the case that it is unnecessary to automatically adjust and eliminate the gap between the circumferential wall of the vane impeller 10 and the inner circumferential wall 203 of the vane chamber 202, which gap is produced due to wear, both the fourth and fifth embodiments can be alternatively based on the structure of the first embodiment and the shaft end gas exhaustion control assemblies 90, 91, 92 can be alternatively disposed on outer side of the main seat main body 30 (or main seat subsidiary body 31) of the main seat 3. Except that the support body assembly 4 and the automatic adjustment assembly 5 are omitted, all the other structures and operations are identical to those of the first embodiment and thus will not be redundantly described hereinafter.

In conclusion, the compressor structure of the present invention can truly reduce the wear extent of the vane and the inner wall of the vane chamber and lower energy loss. Moreover, by means of operating the additionally disposed compression ratio regulation assembly, the compression ratio of the compressor can be easily adjusted. In addition, the compressor structure of the present invention has the function of switching the compression ratio stage by stage. The present invention is inventive and advanced. The above embodiments are only used to illustrate the present invention, not intended to limit the scope thereof. Many modifications of the above embodiments can be made without departing from the spirit of the present invention.

What is claimed is:

1. A compressor structure comprising a vane rotor and a cylinder eccentrically disposed around the vane rotor, the vane rotor and the cylinder being rotatable at the same time, the cylinder being pivotally rotatably disposed on a main seat, the vane rotor having a vane impeller, a circumferential wall of the vane impeller being in tangential contact with an inner circumferential wall of the cylinder to define an eccentric crescent vane chamber in the cylinder, a radial vane slot being formed on the circumference wall of the vane impeller, a vane being slidably received in the vane slot, the vane having an outward extending end formed with vane pivotally connecting sections, by means of the vane pivotally connecting sections, the vane being securely pivotally connected on the cylinder, whereby a top end of the vane tightly abuts against the inner circumferential wall of the vane chamber so that the top end of the vane is in an axial sealed contact with the inner circumferential wall of the vane chamber, whereby an interior of the vane chamber is partitioned by the vane into an intake section and a compression exhaustion section, a gas inlet being disposed in the intake section, a gas outlet being disposed in the compression exhaustion section, the gas inlet and the gas outlet being respectively positioned in different axial positions of the cylinder, a circular cylinder receiving chamber being formed on one side of the main seat, which side faces the cylinder, the cylinder receiving chamber serving to receive one end of the cylinder proximal to the gas outlet and block the gas outlet, at least one connection supports being disposed on the main seat for securely assembling with the cylinder, the connection supports providing supporting effect to form at least one hollow section, whereby one end of the gas inlet is exposed to the hollow section without being blocked by the cylinder receiving chamber, the cylinder receiving chamber having a circular inner circumferential wall, an out-guiding hole being formed between the inner circumferential wall and an outer wall of the main seat in communication with inner side and outer side.

2. The compressor structure as claimed in claim 1, wherein a compression ratio regulation assembly is further disposed between the gas outlet of the cylinder and the out-guiding hole of the main seat, the compression ratio regulation assembly including a regulation member, a regulation opening being disposed on the regulation member corresponding to the out-guiding hole, by means of operating the regulation member, an overlapping position between the regulation opening and the out-guiding hole being changeable, whereby the timing for the gas outlet and the out-guiding hole to communicate with each other to guide out the gas is adjustable so that the compression ratio of the exhausted gas is adjustable.

3. The compressor structure as claimed in claim 2, wherein the vane pivotally connecting sections are vane protruding shafts laterally protruding from two sides of the vane, vane pivotally connected sections being disposed on the cylinder to pivotally connect with the vane pivotally connecting sections, whereby the top end of the vane keeps in an axial sealed contact with the inner circumferential wall of the vane chamber to define an axial vane contact line or the top end of the vane between the two vane pivotally connecting sections is inlaid in a vane inlay channel of the cylinder main body to define an axial vane contact arc face.

4. The compressor structure as claimed in claim 2, wherein a support body assembly disposed on outer side of the main seat, at least one automatic adjustment assembly being disposed between the support body assembly and the main seat, the automatic adjustment assembly being used to drive the main seat and the cylinder to keep the inner circumferential wall of the vane chamber and the circumferential wall of the vane impeller of the vane rotor in tight contact with each other so as to eliminate a gap between the vane rotor and the inner circumferential wall of the vane chamber, the gap is produced due to wear in operation, two ends of an outer periphery of the main seat being respectively formed with two guide slopes, two lateral sides of the support body assembly being respectively formed with two lateral bent edges, lateral perforations being respectively formed on the lateral bent edges in positions corresponding to the guide slopes, the automatic adjustment assembly having a shaft rod, two fastening members and an elastic adjustment member, the two fastening members being slidably fitted on the shaft rod and respectively passed through the lateral perforations of the two symmetrical lateral bent edges, whereby by means of the automatically elastically twisting effect of the elastic adjustment member, the two fastening members get close to the main seat, each of the fastening member being formed with a fastening slope corresponding to the guide slope, by means of the elastic adjustment member, the two fastening members themselves having a function of elastically getting close to each other to fasten the main seat, whereby the fastening slopes always apply a lifting force to the guide slopes of the main seat so that the main seat and the cylinder can automatically get close to and tightly abut against the circumferential wall of the vane impeller of the vane rotor.

5. The compressor structure as claimed in claim 1, wherein the vane pivotally connecting sections are vane protruding shafts laterally protruding from two sides of the vane, vane pivotally connected sections being disposed on the cylinder to pivotally connect with the vane pivotally connecting sections, whereby the top end of the vane keeps in an axial sealed contact with the inner circumferential wall of the vane chamber to define an axial vane contact line or the top end of the vane between the two vane pivotally connecting sections is inlaid in a vane inlay channel of the cylinder main body to define an axial vane contact arc face.

6. The compressor structure as claimed in claim 1, wherein a support body assembly disposed on outer side of the main seat, at least one automatic adjustment assembly being disposed between the support body assembly and the main seat, the automatic adjustment assembly being used to drive the main seat and the cylinder to keep the inner circumferential wall of the vane chamber and the circumferential wall of the vane impeller of the vane rotor in tight contact with each other so as to eliminate a gap between the vane rotor and the inner circumferential wall of the vane chamber, the gap is produced due to wear in operation, two ends of an outer periphery of the main seat being respectively formed with two guide slopes, two lateral sides of the support body assembly being respectively formed with two lateral bent edges, lateral perforations being respectively formed on the lateral bent edges in positions corresponding to the guide slopes, the automatic adjustment assembly having a shaft rod, two fastening members and an elastic adjustment member, the two fastening members being slidably fitted on the shaft rod and respectively passed through the lateral perforations of the two symmetrical lateral bent edges, whereby by means of the automatically elastically twisting effect of the elastic adjustment member, the two fastening members get close to the main seat, each of the fastening member being formed with a fastening slope corresponding to the guide slope, by means of the elastic adjustment member, the two fastening members themselves having a function of elastically getting close to each other to fasten the main seat, whereby the fastening slopes always apply a lifting force to the guide slopes of the main seat so that the main seat and the cylinder can automatically get close to and tightly abut against the circumferential wall of the vane impeller of the vane rotor.

7. A compressor structure comprising a vane rotor and a cylinder eccentrically disposed around the vane rotor, the vane rotor and the cylinder being rotatable at the same time, the cylinder being pivotally rotatably disposed on a main seat, the vane rotor having a vane impeller, a circumferential wall of the vane impeller being in tangential contact with an inner circumferential wall of the cylinder to define an eccentric crescent vane chamber in the cylinder, a radial vane slot being formed on the circumference wall of the vane impeller, a vane being slidably received in the vane slot, the vane having an outward extending end formed with vane pivotally connecting sections, by means of the vane pivotally connecting sections, the vane being securely pivotally connected on the cylinder, whereby a top end of the vane tightly abuts against the inner circumferential wall of the vane chamber so that the top end of the vane is in an axial sealed contact with the inner circumferential wall of the vane chamber, whereby an interior of the vane chamber is partitioned by the vane into an intake section and a compression exhaustion section, a gas inlet being disposed in the intake section, a gas outlet being disposed in the compression exhaustion section, the gas outlet being positioned on the vane impeller in the compression exhaustion section in communication with a gas exhaustion passage formed inside the vane rotor, the gas exhaustion passage being in communication with a gas exhaustion port formed on an end section of at least one of a rotor shaft, a shaft end gas exhaustion control assembly being fitted around the end section of the rotor shaft, along with the rotation of the vane rotor, the shaft end gas exhaustion control assembly controlling the timing of the gas exhaustion port to communicate with outer side.

8. The compressor structure as claimed in claim 7, wherein a rotor shaft socket is formed at a center of the shaft end gas exhaustion control assembly, the rotor shaft socket being fitted on an end section of the rotor shaft with the gas exhaustion port, a part of a circumference of the rotor shaft socket being formed with an out-guiding notch in communication with a gas exhaustion port formed on the shaft end gas exhaustion control assembly in communication with outer side of the shaft end gas exhaustion control assembly to exhaust the gas.

9. The compressor structure as claimed in claim 8, wherein a compression ratio regulation assembly is further fitted between an inner circumference of the rotor shaft socket of the shaft end gas exhaustion control assembly and the outer circumference of the rotor shaft, the compression ratio regulation assembly having a regulation opening in a moving path of the gas exhaustion port, whereby the compression ratio regulation assembly can operate to change an overlapping position of the regulation opening and the out-guiding notch so as to change the timing for the gas exhaustion port and the out-guiding notch to communicate with each other to guide out the air so as to adjust the compression ratio of the exhausted gas.

10. The compressor structure as claimed in claim 9, wherein the vane pivotally connecting sections are vane protruding shafts laterally protruding from two sides of the vane, vane pivotally connected sections being disposed on the cylinder to pivotally connect with the vane pivotally connecting sections, whereby the top end of the vane keeps in an axial sealed contact with the inner circumferential wall of the vane chamber to define an axial vane contact line or the top end of the vane between the two vane pivotally connecting sections is inlaid in a vane inlay channel of the cylinder main body to define an axial vane contact arc face.

11. The compressor structure as claimed in claim 9, wherein a support body assembly disposed on outer side of the main seat, at least one automatic adjustment assembly being disposed between the support body assembly and the main seat, the automatic adjustment assembly being used to drive the main seat and the cylinder to keep the inner circumferential wall of the vane chamber and the circumferential wall of the vane impeller of the vane rotor in tight contact with each other so as to eliminate a gap between the vane rotor and the inner circumferential wall of the vane chamber, the gap is produced due to wear in operation, two ends of an outer periphery of the main seat being respectively formed with two guide slopes, two lateral sides of the support body assembly being respectively formed with two lateral bent edges, lateral perforations being respectively formed on the lateral bent edges in positions corresponding to the guide slopes, the automatic adjustment assembly having a shaft rod, two fastening members and an elastic adjustment member, the two fastening members being slidably fitted on the shaft rod and respectively passed through the lateral perforations of the two symmetrical lateral bent edges, whereby by means of the automatically elastically twisting effect of the elastic adjustment member, the two fastening members get close to the main seat, each of the fastening member being formed with a fastening slope corresponding to the guide slope, by means of the elastic adjustment member, the two fastening members themselves having a function of elastically getting close to each other to fasten the main seat, whereby the fastening slopes always apply a lifting force to the guide slopes of the main seat so that the main seat and the cylinder can automatically get close to and tightly abut against the circumferential wall of the vane impeller of the vane rotor.

12. The compressor structure as claimed in claim 8, wherein the shaft end gas exhaustion control assembly is composed of an end cap seat and an out-guiding notch control ring cap with an opening, the rotor shaft socket being disposed at a center of the end cap seat and fitted around the end section of the rotor shaft with the gas exhaustion port, at least one through hole being formed on the end cap seat in communication with outer side and the rotor shaft socket, a central hole being formed at a center of the rotor shaft socket through the end cap seat, an annular groove being formed on the end cap seat concentrically around the central hole, a rim of the open end of the out-guiding notch control ring cap being inlaid in the annular groove of the end cap seat, the rim of the out-guiding notch control ring cap that is inlaid in the annular groove being formed with at least one annular rail, at least one notch segment being disposed on the annular rail, each notch segment having a notch part, the annular rail corresponding to the through hole of the end cap seat, whereby when the out-guiding notch control ring cap operates, the notch part of each notch segment can correspondingly communicate with the through hole to exhaust the gas in different time periods.

13. The compressor structure as claimed in claim 12, wherein each time period for each notch segment of the annular rail to pass through the through hole just corresponds to one-cycle rotation of the vane rotor so that in one-cycle rotation of the out-guiding notch control ring cap, the corresponding number of the rotational cycles of the vane rotor is the number of the notch segments set on the out-guiding notch control ring cap.

14. The compressor structure as claimed in claim 13, wherein a subsidiary linking member is disposed between the central hole and the annular groove, a linking member being assembled with the end section of the rotor shaft, a driven section being annularly disposed on an inner circumferential wall of the out-guiding notch control ring cap, the subsidiary linking member being drivingly connected between the linking member and the driven section, the through hole on the end cap seat passing through the annular groove in communication with the rotor shaft socket, whereby the out-guiding notch control ring cap can via the linking member first drive the subsidiary linking member and then indirectly drive the driven section to pivotally rotate so that the notch part of the notch segment at the same time communicates with the through hole and the rotor shaft socket to form a gas exhaustion passage.

15. The compressor structure as claimed in claim 12, wherein a subsidiary linking member is disposed between the central hole and the annular groove, a linking member being assembled with the end section of the rotor shaft, a driven section being annularly disposed on an inner circumferential wall of the out-guiding notch control ring cap, the subsidiary linking member being drivingly connected between the linking member and the driven section, the through hole on the end cap seat passing through the annular groove in communication with the rotor shaft socket, whereby the out-guiding notch control ring cap can via the linking member first drive the subsidiary linking member and then indirectly drive the driven section to pivotally rotate so that the notch part of the notch segment at the same time communicates with the through hole and the rotor shaft socket to form a gas exhaustion passage.

16. The compressor structure as claimed in claim 12, wherein the vane pivotally connecting sections are vane protruding shafts laterally protruding from two sides of the vane, vane pivotally connected sections being disposed on the cylinder to pivotally connect with the vane pivotally connecting sections, whereby the top end of the vane keeps in an axial sealed contact with the inner circumferential wall of the vane chamber to define an axial vane contact line or the top end of the vane between the two vane pivotally connecting sections is inlaid in a vane inlay channel of the cylinder main body to define an axial vane contact arc face.

17. The compressor structure as claimed in claim 12, wherein a support body assembly disposed on outer side of the main seat, at least one automatic adjustment assembly being disposed between the support body assembly and the main seat, the automatic adjustment assembly being used to drive the main seat and the cylinder to keep the inner circumferential wall of the vane chamber and the circumferential wall of the vane impeller of the vane rotor in tight contact with each other so as to eliminate a gap between the vane rotor and the inner circumferential wall of the vane chamber, the gap is produced due to wear in operation, two ends of an outer periphery of the main seat being respectively formed with two guide slopes, two lateral sides of the support body assembly being respectively formed with two lateral bent edges, lateral perforations being respectively formed on the lateral bent edges in positions corresponding to the guide slopes, the automatic adjustment assembly having a shaft rod, two fastening members and an elastic adjustment member, the two fastening members being slidably fitted on the shaft rod and respectively passed through the lateral perforations of the two symmetrical lateral bent edges, whereby by means of the automatically elastically twisting effect of the elastic adjustment member, the two fastening members get close to the main seat, each of the fastening member being formed with a fastening slope corresponding to the guide slope, by means of the elastic adjustment member, the two fastening members themselves having a function of elastically getting close to each other to fasten the main seat, whereby the fastening slopes always apply a lifting force to the guide slopes of the main seat so that the main seat and the cylinder can automatically get close to and tightly abut against the circumferential wall of the vane impeller of the vane rotor.

18. The compressor structure as claimed in claim 7, wherein the vane pivotally connecting sections are vane protruding shafts laterally protruding from two sides of the vane, vane pivotally connected sections being disposed on the cylinder to pivotally connect with the vane pivotally connecting sections, whereby the top end of the vane keeps in an axial sealed contact with the inner circumferential wall of the vane chamber to define an axial vane contact line or the top end of the vane between the two vane pivotally connecting sections is inlaid in a vane inlay channel of the cylinder main body to define an axial vane contact arc face.

19. The compressor structure as claimed in claim 7, wherein a support body assembly disposed on outer side of the main seat, at least one automatic adjustment assembly being disposed between the support body assembly and the main seat, the automatic adjustment assembly being used to drive the main seat and the cylinder to keep the inner circumferential wall of the vane chamber and the circumferential wall of the vane impeller of the vane rotor in tight contact with each other so as to eliminate a gap between the vane rotor and the inner circumferential wall of the vane chamber, the gap is produced due to wear in operation, two ends of an outer periphery of the main seat being respectively formed with two guide slopes, two lateral sides of the support body assembly being respectively formed with two lateral bent edges, lateral perforations being respectively formed on the lateral bent edges in positions corresponding to the guide slopes, the automatic adjustment assembly having a shaft rod, two fastening members and an elastic adjustment member, the two fastening members being slidably fitted on the shaft rod and respectively passed through the lateral perforations of the two symmetrical lateral bent edges, whereby by means of the automatically elastically twisting effect of the elastic adjustment member, the two fastening members get close to the main seat, each of the fastening member being formed with a fastening slope corresponding to the guide slope, by means of the elastic adjustment member, the two fastening members themselves having a function of elastically getting close to each other to fasten the main seat, whereby the fastening slopes always apply a lifting force to the guide slopes of the main seat so that the main seat and the cylinder can automatically get close to and tightly abut against the circumferential wall of the vane impeller of the vane rotor.

* * * * *